US011504971B2

(12) United States Patent
Mizuno et al.

(10) Patent No.: US 11,504,971 B2
(45) Date of Patent: Nov. 22, 2022

(54) LIQUID EJECTING APPARATUS

(71) Applicant: SEIKO EPSON CORPORATION, Tokyo (JP)

(72) Inventors: Shota Mizuno, Shiojiri (JP); Tetsuya Miyagawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 85 days.

(21) Appl. No.: 16/751,510

(22) Filed: Jan. 24, 2020

(65) Prior Publication Data

US 2020/0238710 A1 Jul. 30, 2020

(30) Foreign Application Priority Data

Jan. 28, 2019 (JP) ..... JP2019-011964

(51) Int. Cl.
*B41J 2/175* (2006.01)
*B41J 13/02* (2006.01)

(52) U.S. Cl.
CPC ..... *B41J 2/175* (2013.01); *B41J 13/02* (2013.01)

(58) Field of Classification Search
CPC .... B41J 2/175; B41J 2/17509; B41J 2/17523; B41J 29/02
See application file for complete search history.

(56) References Cited

U.S. PATENT DOCUMENTS 5,561,453 A * 10/1996 Shibata ..... F16L 11/121 138/119
6,106,098 A * 8/2000 Nakamura ..... B41J 2/16547 347/30
6,422,693 B2 * 7/2002 Pawlowski, Jr. .... B41J 2/14145 347/84
9,409,403 B2 * 8/2016 Koike ..... B41J 2/175
2001/0026304 A1 * 10/2001 Matsuzaki ..... B41J 29/38 347/85
2006/0187288 A1 * 8/2006 Nishida ..... B41J 2/1752 347/104
2006/0192833 A1 * 8/2006 Samoto ..... B41J 19/005 347/108
2007/0229625 A1 * 10/2007 Yano ..... B41J 2/1752 347/86

(Continued)

FOREIGN PATENT DOCUMENTS

JP 2007-168403 7/2007
JP 2012-179728 A 9/2012

*Primary Examiner* — John Zimmermann
(74) *Attorney, Agent, or Firm* — Workman Nydegger

(57) ABSTRACT

A liquid ejecting apparatus includes a carriage unit including a liquid ejecting head and reciprocating in a scanning direction; a liquid container; and a tube supplying liquid sent from the liquid container to the carriage unit. When the carriage unit moves, in a case in which one direction is referred to as a first direction and another direction is referred to as a second direction, the tube extends from the liquid container in the second direction, forms a curved portion curving toward upstream in a transport direction of a medium, is folded back in the first direction, and is coupled to the carriage unit. The carriage unit includes a space that expands in the transport direction upstream of an area in which a portion extending from a coupling start point of the tube toward the curved portion is displaced in accordance with movement of the carriage unit.

11 Claims, 9 Drawing Sheets

(56) References Cited

U.S. PATENT DOCUMENTS

| | | | | |
|---|---|---|---|---|
| 2009/0167834 | A1* | 7/2009 | Kuriki | B41J 2/17509 347/108 |
| 2011/0216137 | A1* | 9/2011 | Okano | B41J 2/175 347/86 |
| 2012/0038719 | A1* | 2/2012 | Shimizu | B41J 2/175 347/86 |
| 2012/0050416 | A1* | 3/2012 | Ishizawa | B41J 2/175 347/85 |
| 2012/0051822 | A1* | 3/2012 | Yajima | B41J 29/02 400/283 |
| 2012/0217701 | A1* | 8/2012 | Suzuki | B41J 29/00 271/264 |

* cited by examiner

LIQUID EJECTING APPARATUS

The present application is based on, and claims priority from JP Application Serial Number 2019-011964, filed Jan. 28, 2019, the disclosure of which is hereby incorporated by reference herein in its entirety.

BACKGROUND

1. Technical Field

The present disclosure relates to a liquid ejecting apparatus including a carriage unit that has a liquid ejecting head ejecting liquid onto a medium.

2. Related Art

JP-A-2012-179728 discloses a serial type recording apparatus (an example of a liquid ejecting apparatus) including a carriage that has a recording head (an example of a liquid ejecting head). The recording apparatus includes a first guide portion disposed along a moving direction of the carriage. A base end portion of the carriage is slidably attached to the first guide portion via first sliding portions positioned at both ends in a width direction. The recording apparatus includes an ink tube that supplies ink from a liquid supply source to the carriage. One end of the ink tube is coupled to the liquid supply source, and the other end is coupled to the recording head at a tip of the carriage via a U-shaped reversing portion. A tube holding member, which holds the ink tube at a position near a coupling portion coupled to the recording head, is fixed to the carriage. The position where the tube holding member is fixed to the carriage is between the first sliding portions positioned at both ends of the carriage in the width direction. The recording apparatus adopts a structure in which tubes are routed so that a plurality of ink tubes are horizontally curved at the U-shaped reversing portion in a state in which the tubes are aligned in a vertical direction.

However, in a structure in which tubes are routed in a state of being horizontally curved, a curved state of portions of the tubes, which extend from a coupling location to the carriage, may be changed according to a position of the carriage on a movement path, and thus the tubes may come into contact with the carriage. In such a case, the carriage receives a reaction force of the tube not only at the coupling location but also at the contact location, and the position and direction receiving the reaction force of the tubes change. Therefore, a posture of the carriage deviates and sliding resistance of the carriage changes. The deviation of the posture of the carriage causes a change in a liquid ejecting direction, while the change in the sliding resistance of the carriage causes a change in a speed of the carriage. There is a problem in that printing accuracy is decreased due to at least one of the change in the liquid ejecting direction and the change in the speed of the carriage. The problem is not limited to the structure in which a plurality of tubes are aligned and routed, and there is the similar problem even in a structure of one tube is routed.

SUMMARY

According to an aspect of the present disclosure, there is provided a liquid ejecting apparatus including: a carriage unit that includes a liquid ejecting head ejecting liquid onto a medium and reciprocates in a scanning direction of the liquid ejecting head; a liquid container configured to store the liquid to be supplied to the liquid ejecting head and provided at a position different from a position where the carriage unit is disposed; and a tube that supplies the liquid sent from the liquid container to the carriage unit. When the carriage unit reciprocates, in a case in which one direction is referred to as a first direction and another direction is referred to as a second direction, the tube extends from the liquid container in the second direction, forms a curved portion curving toward upstream in a transport direction of the medium, is folded back in the first direction, and is coupled to the carriage unit. The carriage unit includes a space that expands in the transport direction upstream of an area in which a part of the tube extending from a coupling start point of coupling the tube to the carriage unit toward the curved portion is displaced in accordance with movement of the carriage unit.

DESCRIPTION OF EXEMPLARY EMBODIMENTS

First Embodiment

Figure 1:
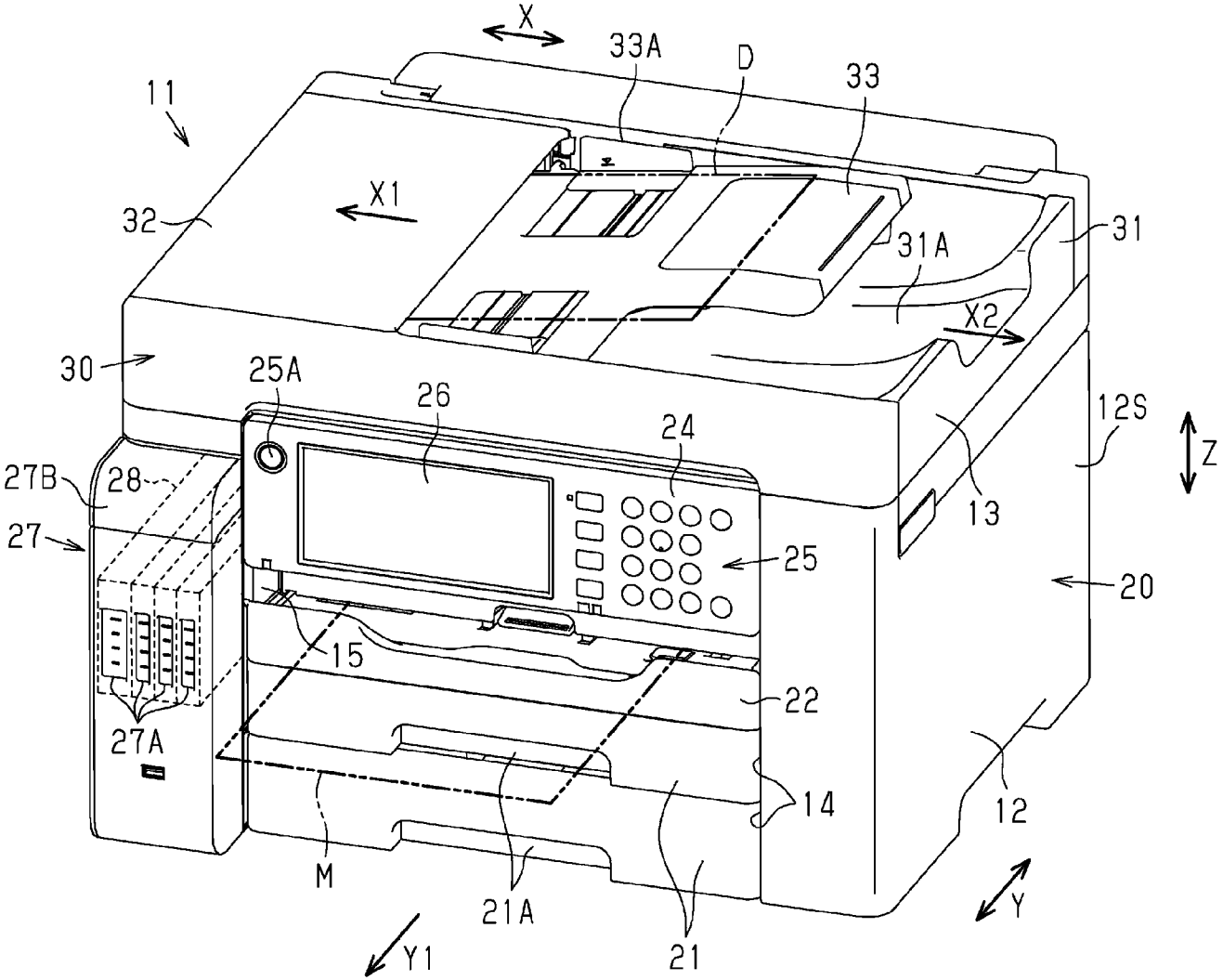
FIG. 1 is a perspective view of a liquid ejecting apparatus according to a first embodiment.

Hereinafter, a first embodiment of a liquid ejecting apparatus will be described with reference to the drawings. In FIG. 1, assuming that a liquid ejecting apparatus 11 is placed on a horizontal plane, three virtual axes orthogonal to each other are defined as an X-axis, a Y-axis, and a Z-axis. The Z-axis is parallel to a vertical direction, the X-axis is parallel to a scanning direction of a liquid ejecting head, and the Y-axis is parallel to a transport direction of a medium during printing. One direction parallel to the Y-axis is a transport direction Y1 of the medium during printing. In the Y-axis, a surface of a housing 12 on which an operation panel to be described later is disposed may be referred to as a front surface, and a surface opposite to the front surface may be referred to as a back surface.

The liquid ejecting apparatus 11 illustrated in FIG. 1 is a serial printing-type ink jet printer. As illustrated in FIG. 1, the liquid ejecting apparatus 11 includes the rectangular parallelepiped housing 12 and a cover 13 provided on an upper side of the housing 12 so as to be openable and closable, for example, with a back surface side as a rotation axis. The liquid ejecting apparatus 11 is, for example, a multifunction machine, and includes a printing unit 20 that occupies most of the housing 12, and a reading unit 30 configured of an upper end portion of the housing 12 and the cover 13. A cassette 21, which is an example of a medium accommodation portion, is inserted, in an attachable and detachable state, into a recess portion 14 provided in a front lower portion of the housing 12. The cassette 21 stores a plurality of recording media M (hereinafter also simply referred to as the "media M") such as sheets. At a front center portion of each cassette 21, there is provided an operated portion 21A to which a finger of a user hooked for the attachment and detachment. In the example illustrated in FIG. 1, the cassettes 21 are provided in two stages in a vertical direction Z1. The number of cassettes 21 may be one, or may be a plurality of three or more stages.

A discharge port 15 through which the printed medium M is discharged is open at a position above the cassette 21 in the housing 12. An extendable discharge tray 22 is provided between the discharge port 15 and the cassette 21. The discharge tray 22 is used in a state of being extended to a downstream in a transport direction Y1, and the printed medium M after printing is discharged and stacked on the discharge tray 22. The housing 12 is provided with an operation panel 24 at a position above the discharge port 15. The operation panel 24 includes an operation section 25 including a plurality of switches that are operated when the user gives an instruction to the liquid ejecting apparatus 11, and a display section 26 that displays menus, messages, or the like. The operation section 25 includes a power switch 25A, a selection switch, and the like. Here, the display section 26 may be a touch panel, and an operation function of the display section 26 may also serve as a part of the operation section 25. In the drawing, one direction of the X-axis is defined as a first direction X1, and the other direction of the X-axis is defined as a second direction X2.

As illustrated in FIG. 1, the cover 13 is a platen cover 31 of the reading unit 30 in the present example, and an automatic document feeding device (auto document feeder) 32 is provided thereon, which includes a document tray 33 on which a plurality of documents can be stacked (set). The reading unit 30 has a sheet feeder type scanner function of feeding a document D positioned in a width direction by an edge guide 33A one by one from the document tray 33 and reading the document D, and a flatbed type scanner function of reading the document D placed on the platen exposed when the platen cover 31 is opened. In the sheet feeder type scanner function, the documents D fed one by one in the first direction X1 are read by the reading unit 30 and then discharged in the second direction X2, and stacked on the discharge tray 31A.

As described above, in addition to an ink jet type printing function, the liquid ejecting apparatus 11, which is the multifunction machine including the reading unit 30, has a scanner function of reading the document D by the reading unit 30 and a copy printing function of printing an image of the document D read by the reading unit 30.

As illustrated in FIG. 1, a liquid supply unit 27 is provided at one end portion of the front portion of the housing 12. In the liquid supply unit 27, a plurality of liquid containers 28 (see also FIG. 2) for storing liquid such as ink are stored. The plurality of liquid containers 28 store, for example, inks having different colors of black, cyan, magenta, and yellow. The liquid stored in the liquid container 28 is used for printing by being ejected onto the medium M by the liquid ejecting apparatus 11. The liquid supply unit 27 has a plurality of windows 27A, on the front surface, each indicating an amount of the liquid for corresponding one of the liquid containers 28. The liquid container 28 is, for example, an ink tank but may be an ink pack or an ink cartridge.

The liquid supply unit 27 has a lid 27B capable of opening and closing at the top. For example, in a case in which the amount of the liquid decreases when viewed through the window 27A, the user opens the lid 27B and replenishes the liquid container 28 through a supply port (not illustrated) thereof with the liquid such as ink from an ink bottle (not illustrated).

Figure 2:
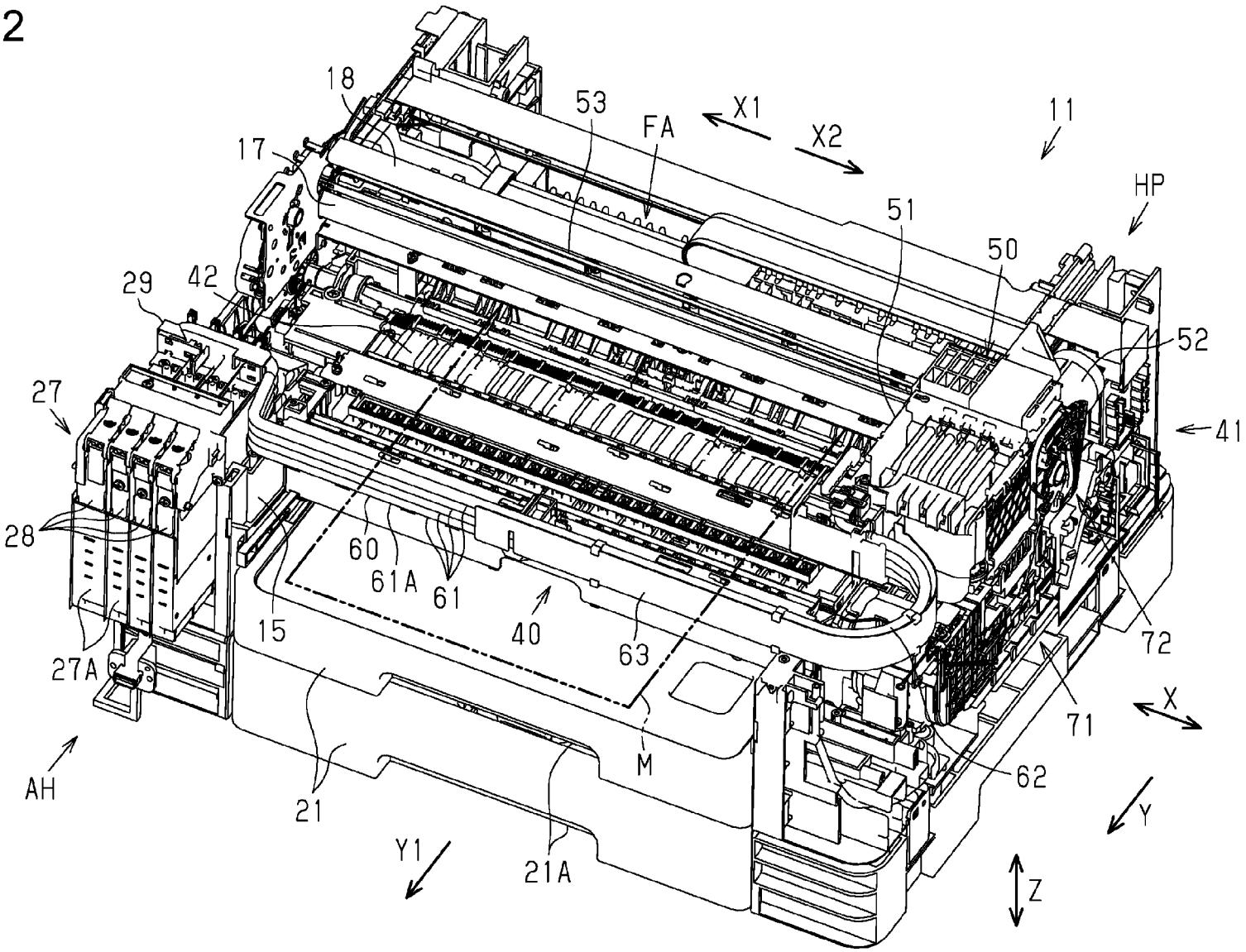
FIG. 2 is a perspective view illustrating the liquid ejecting apparatus in a state in which a housing is removed.

FIG. 2 illustrates an internal structure of the liquid ejecting apparatus 11 in a state in which the housing 12 is removed.

As illustrated in FIG. 2, the liquid ejecting apparatus 11 has a transport region FA to which the medium M supplied from the cassette 21 is transported, at the center portion in the scanning direction X. The liquid ejecting apparatus 11 includes a transport section 40 that feeds the medium M to be printed one by one from the cassette 21 and transports the medium M along a path passing through the transport region FA, and a carriage unit 50 that performs printing by ejecting the liquid while moving relative to the medium M in the transport region FA.

The transport section 40 includes a feeder 41 that feeds the medium M from the cassette 21 one by one, on the back of the liquid ejecting apparatus 11. The feeder 41 has a plurality of intermediate rollers (not illustrated) disposed side by side in the transport direction Y1. The feeder 41 reverses the medium M fed rearward from the cassette 21 by the rotation of a pickup roller (not illustrated) along an outer periphery of the intermediate roller, and then transports the medium M in the transport direction Y1 through the transport region FA. A support base 42 that supports the medium M to be printed by the carriage unit 50 is disposed in the transport region FA. The transport section 40 includes a plurality of rollers along the transport path, and transports the medium M in the transport direction Y1 by the rotation of the rollers.

As illustrated in FIG. 2, the carriage unit 50 includes a carriage 51 that is provided to be reciprocally movable in the scanning direction X, and a liquid ejecting head 54 (see FIG. 3) that is provided below the carriage 51 and ejects the liquid onto the medium M. As illustrated in FIG. 2, the carriage unit 50 is supported so as to be movable in the scanning direction X by being guided by the first guide member 17 and the second guide member 18, respectively. The carriage unit 50 reciprocates in the scanning direction X along each of the guide members 17 and 18. A carriage motor 52 serving as a drive source for the carriage unit 50 is disposed behind one end of the movement path of the carriage unit 50 in the liquid ejecting apparatus 11. A driving force of the carriage motor 52 is transmitted to the carriage unit 50 via an endless timing belt 53. The timing belt 53 is stretched along the first guide member 17 so as to be wound around a pair of pulleys (not illustrated) and extend in the scanning direction X. One pulley is coupled to an output shaft of the carriage motor 52. When the carriage motor 52 is driven forward, the carriage unit 50 moves forward in the first direction X1, and when the carriage motor 52 is driven reversely, the carriage unit 50 moves backward in the second direction X2.

In FIG. 2, the carriage unit 50 is positioned at a home position HP (home position) at which the carriage unit 50 waits during non-printing when printing is not performed on the medium M. As illustrated in FIG. 2, in the present example, a position, when the carriage unit 50 is at the end portion opposite to a disposition position of the liquid supply unit 27 in the scanning direction X, is the home position HP. A position of the end portion opposite to the home position HP in the scanning direction X is an anti-home position AH (see also FIG. 7) of the carriage 51. When printing is performed on the medium M, the carriage 51 reciprocates in a print area corresponding to a width of the medium M within a movable range between the home position HP and the anti-home position AH.

As illustrated in FIG. 2, the liquid container 28 can store the liquid supplied to the liquid ejecting head 54 (see FIG. 3), and is provided at a different installation position from the carriage unit 50. In the present example, the liquid container 28 that supplies the liquid to the carriage unit 50 is disposed at the installation position on an anti-home position AH side opposite to the home position HP of the carriage unit 50. The liquid ejecting apparatus 11 includes a tube 61 that is coupled to the carriage unit 50 and supplies the liquid sent from the liquid container 28 to the carriage unit 50. The tube 61 is formed of, for example, a flexible synthetic resin material.

The liquid supply unit 27 has a mounting portion 29 having a supply pipe (not illustrated) into which the liquid container 28 is inserted. The tube 61 is routed in the scanning direction X in a downstream area from the movement path of the carriage unit 50 in the transport direction Y1, in which one end portion is coupled to the mounting portion 29 and the other end portion is coupled to the carriage unit 50. In this way, the plurality of liquid containers 28 and the carriage 51 are coupled through a plurality of tubes 61 corresponding thereto. The plurality of tubes 61 are routed as a tube bundle 60 that is held in a state of being aligned in a line in the vertical direction Z1. The mounting portion 29 may include a pump that supplies the liquid from the liquid container 28 to the carriage unit 50.

Here, when the carriage unit 50 reciprocates, in a case in which one direction is referred to as the first direction X1, and the other direction is referred to as the second direction X2, the tube 61 extends from the liquid container 28 side in the second direction X2, and then forms a curved portion 62 curving toward the upstream in the transport direction Y1 of the medium M. The tube 61 is folded back in the first direction X1 to be coupled to the carriage unit 50. After the tube 61 extends from the mounting portion 29, the tube 61 is routed straight along a front inner surface of the housing 12 in the scanning direction X. After that, a U-shaped curved portion 62 that is curved and folded back horizontally from the downstream to the upstream in the transport direction Y1 in a portion of middle of an entire length.

A direction in which the liquid flows in the tube 61 is the liquid supply direction. The tube 61 includes a first straight portion 61A at which the upstream portion from the curved portion 62 in the liquid supply direction extends substantially horizontally, and a second straight portion 61B at which the downstream portion from the curved portion 62 in the liquid supply direction extends substantially horizontally. A lengths of each of the first straight portion 61A and the second straight portion 61B changes as a formation position of the curved portion 62 changes in accordance with the movement of the carriage unit 50. The plurality of tubes 61 constituting the tube bundle 60 are disposed in a line so as to overlap each other in the vertical direction Z1.

In the liquid ejecting apparatus 11, a fixed portion in the first straight portion 61A of the tube 61, near the liquid container 28 that is not displaced by the movement of the carriage unit 50 is directly or via a member fixed to the front inner surface of the housing 12 by a support member (not illustrated). Sagging of the tube bundle 60 is suppressed by supporting a portion, except for the fixed portion, which is displaced in a longitudinal direction by a support member 63 formed of a flexible film or sheet.

In the present embodiment, the other end portion of the tube 61 is coupled to a downstream end portion of the carriage unit 50 in the transport direction Y1. Therefore, the first straight portion 61A of the tube 61 and the carriage unit 50 are positioned at a distance of substantially 1.5 to 2 times a curvature radius of the curved portion 62 in the transport direction Y1. That is, a movement space for the curved portion 62 is secured in a region of the downstream of the movement path of the carriage unit 50 in the transport direction Y1. The carriage unit 50 performs printing on the medium M by ejecting the liquid, which is supplied from the liquid container 28 through the tube 61, from the liquid ejecting head 54 (see FIG. 3) while reciprocating in the scanning direction X.

A maintenance mechanism 71 that performs cleaning of the liquid ejecting head 54 (see FIG. 3) is disposed at a position corresponding to a position immediately below the carriage unit 50 disposed at the home position HP. Further, the liquid ejecting apparatus 11 includes a gap adjusting mechanism 72 that adjusts a gap between the liquid ejecting head 54 and the medium M according to a type of the medium M by changing a height position of the liquid ejecting head 54 with respect to the support base 42.

Figure 3:
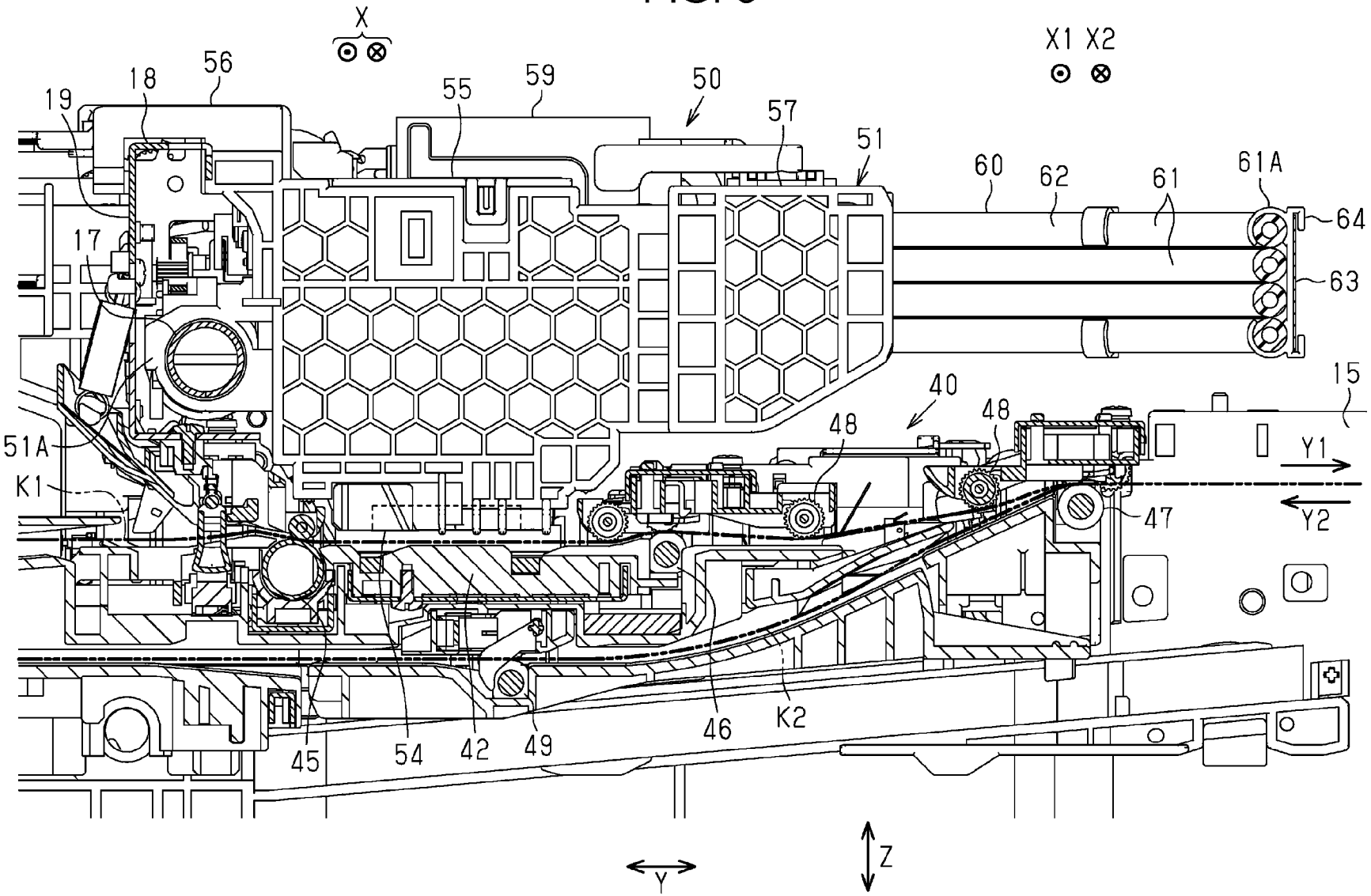
FIG. 3 is a side view of a carriage unit and a periphery thereof viewed from an anti-home position side.
Figure 4:
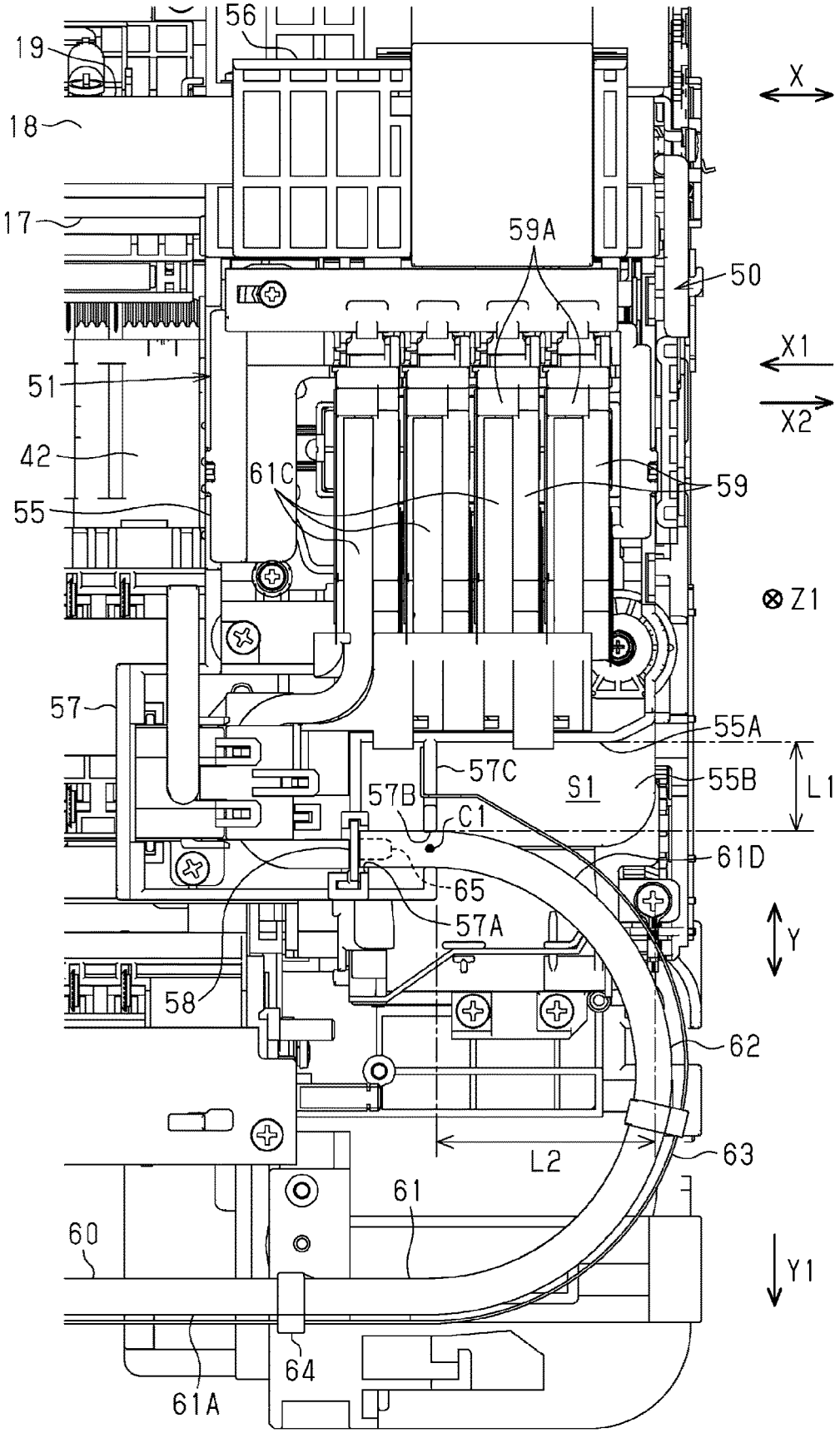
FIG. 4 is a plan view illustrating the carriage unit and the periphery thereof.
Figure 5:
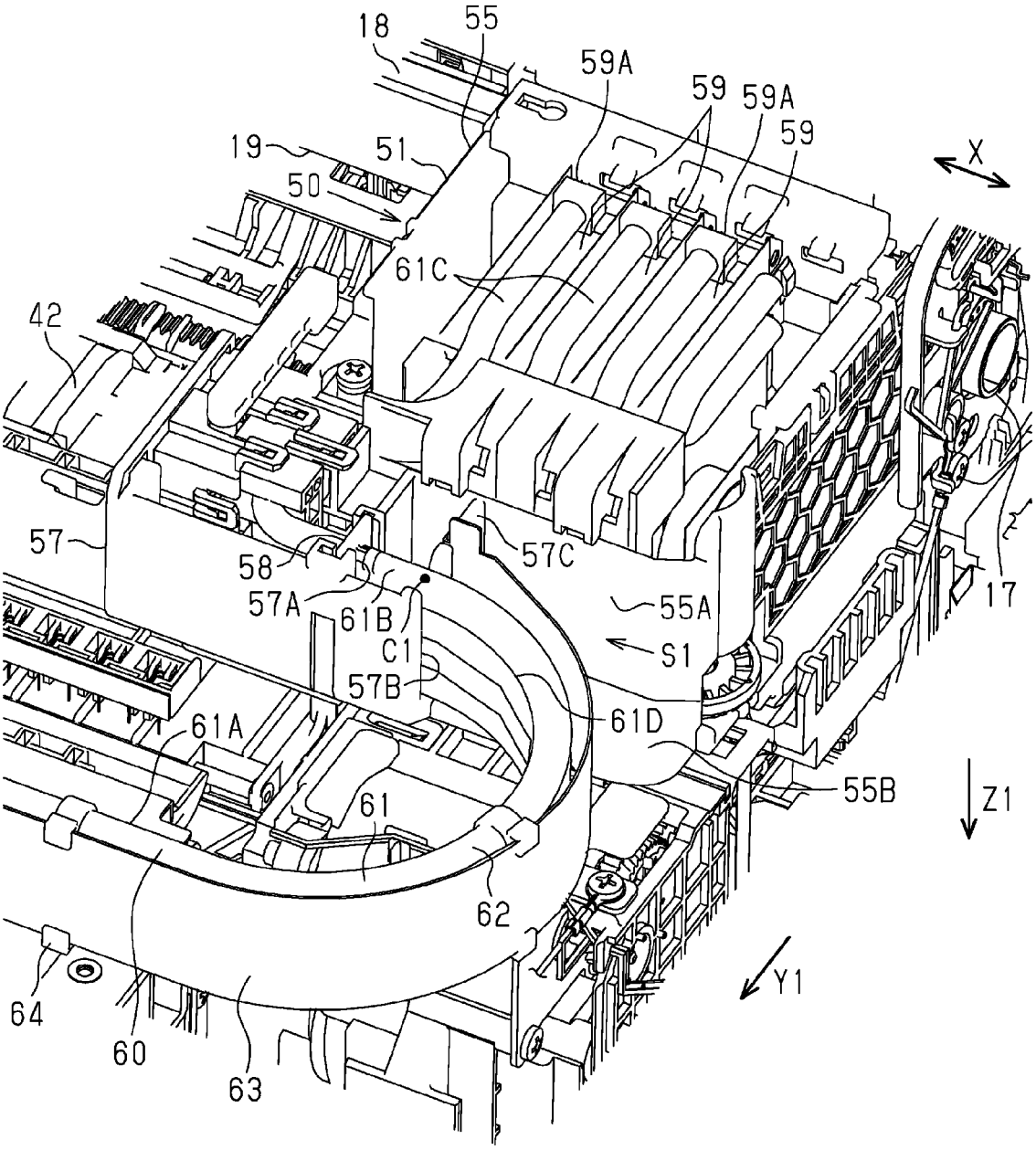
FIG. 5 is a perspective view illustrating the carriage unit and the periphery thereof.

As illustrated in FIGS. 3 to 5, the carriage 51 includes a rectangular box-shaped storage portion 55 that is open upward, an extension portion 56 that extends rearward from a rear upper portion of the storage portion 55, and a protruding portion 57 protruding forward from the front of the storage portion 55 toward downstream in the transport direction Y1. A plurality of liquid reservoirs 59, in which the liquids of the respective colors supplied from the plurality of tubes 61 are temporarily reserved, are stored in the storage portion 55. The liquid reservoir 59 has a substantially rectangular parallelepiped shape, and the same number as the number of the tubes 61 is disposed in a line in the scanning direction X, and each liquid reservoir 59 reserves the liquid supplied from each tube 61. The liquid reserved in each liquid reservoir 59 is supplied to the liquid ejecting head 54.

As illustrated in FIG. 3, the first guide member 17 and the second guide member 18 guide the carriage unit 50 in the scanning direction X at a position on the opposite side of the tube 61 in the transport direction Y1 and are respectively disposed at differ positions in the vertical direction Z1. The first guide member 17 is a main shaft constituted by a columnar guide shaft. Moreover, the second guide member 18 is constituted by forming a part of a main frame 19 formed of sheet metal, in an inverted U shape in cross section. The carriage unit 50 has a pair of coupling portions 51A (see FIG. 7) having round holes through which the first guide member 17 is inserted, on a back surface thereof. The carriage unit 50 is supported so as to be movable with respect to the first guide member 17 by the pair of coupling portions 51A in the scanning direction X. The carriage unit 50 is supported at two locations which are different in position in the scanning direction X via the pair of coupling portions 51A, so that the rotation around the Z-axis is regulated.

As illustrated in FIG. 3, the second guide member 18 is disposed at a position above the first guide member 17 in the vertical direction Z1. The extension portion 56 is supported so as to be movable in the scanning direction X with respect to the second guide member 18, whereby the rotation of the carriage unit 50 around the X-axis with respect to the first guide member 17, particularly in the clockwise direction in FIG. 3, is regulated. The carriage unit 50 may be provided with an urging mechanism for urging the first guide member 17 with springs (not illustrated) in respective directions of the X-axis, the Y-axis, and the Z-axis so as to suppress rattling in each direction of three-axis. However, in the present embodiment, since a deviation of the posture of the carriage unit 50 can be suppressed without being urged by the spring, all the springs in three-axis may be eliminated or a spring in one-axis or springs in two-axis may be eliminated. Even when the urging mechanism for urging in at least one axis with the spring is provided, an urging force of the spring may be set weak because the deviation of the posture of the carriage unit 50 can be suppressed.

As illustrated in FIG. 3, the carriage unit 50 includes the liquid ejecting head 54 that ejects the liquid onto the medium M and reciprocates in the scanning direction X of the liquid ejecting head 54. The support base 42 supporting the medium M is disposed at a lower position facing the moving region of the liquid ejecting head 54. An appropriate gap is secured between the medium M supported by the support base 42 and the liquid ejecting head 54. While the carriage unit 50 reciprocates in the scanning direction X along the first guide member 17, the liquid ejecting head 54 ejects the liquid toward the medium M, whereby an image or the like is printed on the medium M.

Specifically, a scanning operation in which the liquid ejecting head 54 ejects the liquid to perform printing for one scan on the medium M while the carriage unit 50 moves in the scanning direction X, and a transport operation in which the transport section 40 transports the medium M to a next printing position are alternately repeated, so that printing is performed on the medium M. The printed medium M is discharged from the discharge port 15 by the transport section 40 and stacked on the discharge tray 22 (see FIG. 1).

As illustrated in FIG. 3, the transport section 40 transports the medium M that is a target onto which the liquid ejecting head 54 ejects the liquid. The transport section 40 has a first transport path K1 through which the medium M is transported in the first transport direction Y1 during printing, and a second transport path K2 through which the medium M, which has finished printing on a first surface during double-sided printing, is transported in the second transport direction Y2 that is a direction opposite to the first transport direction Y1. The transport section 40 includes a transport roller pair 45, a first discharge roller pair 46, and a second discharge roller pair 47 disposed in order from the upstream to the downstream in the first transport direction Y1 along the first transport path K1.

The transport roller pair 45 is disposed at a position in the upstream of the position of the scanning path of the liquid ejecting head 54 in the transport direction Y1. The first discharge roller pair 46 and the second discharge roller pair 47 are disposed at positions downstream of the liquid ejecting head 54 in the transport direction Y1. The second discharge roller pair 47 is positioned downstream of the first discharge roller pair 46 in the transport direction Y1. Each of the roller pairs 45 to 47 is driven by the power of a transport motor (not illustrated). The two discharge roller pairs 46 and 47 are driven in conjunction with the transport roller pair 45 to transport the medium M during printing and discharge the medium M after printing. One or more floating rollers 48 that guide the medium M along the first transport path K1 are provided at positions along the first transport path K1. The tube 61 is routed in a state in which the curved portion 62 is positioned above the second discharge roller pair 47.

Further, as illustrated in FIG. 3, a coupling location between the first transport path K1 and the second transport path K2 is provided between the first discharge roller pair 46 and the second discharge roller pair 47. The medium M of which the first surface is printed during double-sided printing is discharged by the second discharge roller pair 47 in the transport direction Y1, and when the rear end of the medium M passes through an entrance to the second transport path K2, the rotation of the second discharge roller pair 47 is reversed. Therefore, the medium M is transported to be switched back, and as a result of the switchback transport, the medium M is transported backward to the second transport path K2. A reversing roller pair 49 is provided at a position along the second transport path K2. The medium M is transported backward to the upstream through the second transport path K2 by the reversing roller pair 49, and then reversed by passing through an outer periphery of an intermediate roller (not illustrated). Then, the reversed medium M is fed again toward a printing position that can face the liquid ejecting head 54.

As illustrated in FIG. 3, in the liquid ejecting apparatus 11 of the present embodiment, two pairs of the first discharge roller pair 46 and the second discharge roller pair 47 are disposed downstream of the liquid ejecting head 54 in the transport direction Y1. Therefore, compared to a configuration in which only one discharge roller pair is disposed, a wide space in the transport direction Y1 is secured in the downstream area of the carriage unit 50. The wide space is used as a space for routing the tube 61, and the tube 61 is routed so that the curved portion 62 is positioned above the second discharge roller pair 47, and a tip portion of the tube 61 is coupled to the downstream end portion of the carriage 51.

As illustrated in FIGS. 4 and 5, the protruding portion 57 has a width dimension that is approximately half a width dimension of the storage portion 55, and protrudes in the downstream in the transport direction Y1 from a position that is deviated, in a direction opposite to the home position HP, with respect to the storage portion 55 in the scanning direction X. The carriage unit 50 has a space S1 at a position on the home position HP side with respect to the protruding portion 57. In the protruding portion 57, a joint member 58, which couples the tube 61 coupled to the carriage unit 50 and the tube 61C drawn into the protruding portion 57, is assembled in a recess portion 57A. The joint member 58 has a pipe portion 65 (see FIG. 4) that protrudes from both surfaces in the scanning direction X, and the tip portion of the tube 61 is extrapolated to the pipe portion 65 so that the tip portion of the tube 61 is coupled to the carriage unit 50. Further, a plurality of tubes 61C having each one end portion coupled to the joint member 58 are routed inside the carriage 51 while changing the direction of the arrangement from the arrangement aligned in a line in the vertical direction Z1 to the arrangement aligned in a line in the scanning direction X. Each other end portion is coupled to a supply port 59A of each liquid reservoir 59. The support member 63 is provided along a side surface of a portion of the tube 61 that changes to be bent in accordance with movement of the carriage unit 50. The support member 63 is held by a plurality of holding members 64 attached to the tube 61 at intervals in the longitudinal direction.

As illustrated in FIGS. 4 and 5, a regulation portion 57B that regulates the tube 61 extending from the joint member 58 is provided at the end portion of the protruding portion 57 near the home position HP from the joint member 58. A location where the tube 61 is regulated by the regulation portion 57B in the carriage unit 50 is a coupling start point C1 of the tube 61. In the present example, the regulation portion 57B is formed of a recess portion having a width that is the same as or slightly shorter than an outer diameter of the tube 61. A portion of the tube 61, which is pinched to be regulated by the regulation portion 57B formed of the recess portion, is the coupling start point C1. Therefore, the carriage unit 50 receives a reaction force of the tube 61 at the position of the regulation portion 57B, that is, the coupling start point C1. In this respect, the coupling start point C1 is also a curving start point at which the tube 61 curves during the movement of the carriage unit 50. The coupling start point C1 does not indicate one point on the outer periphery of the tube 61 but indicates a region extending over the outer periphery of the tube 61.

In the present example, the regulation portion 57B is positioned at the center portion of the carriage unit 50 in the scanning direction X. Therefore, the carriage unit 50 receives the reaction force of the tube 61 at the center portion in the scanning direction X. In the example illustrated in FIGS. 4 and 5, the regulation portion where the tube 61 is pinched by the regulation portion 57B formed of the recess portion is formed as the coupling start point C1, but is not limited thereto. For example, the regulation portion 57B is a recess portion having a sufficiently wide width that is, for example, twice or more the outer diameter of the tube 61, and is a recess portion that does not come into contact with the tube 61 even when the tube 61 is displaced. Therefore, a configuration may be provided in which the tip portion of the tube 61, which is extrapolated to the pipe portion 65 of the joint member 58 so as to be regulated, is the coupling start point C1.

As illustrated in FIGS. 4 and 5, the carriage unit 50 includes the space S1 wider toward the upstream in the transport direction Y1 than an area in which a portion 61D that is a portion extending from the coupling start point C1 toward the curved portion 62 in the tube 61 is displaced in accordance with movement of the carriage unit 50. That is, the space S1 is provided in which the portion 61D does not come into contact with the carriage unit 50, even if the portion 61D extending from the coupling start point C1 of the tube 61 in the second direction X2 is displaced most to the upstream in the transport direction Y1.

Figure 7:
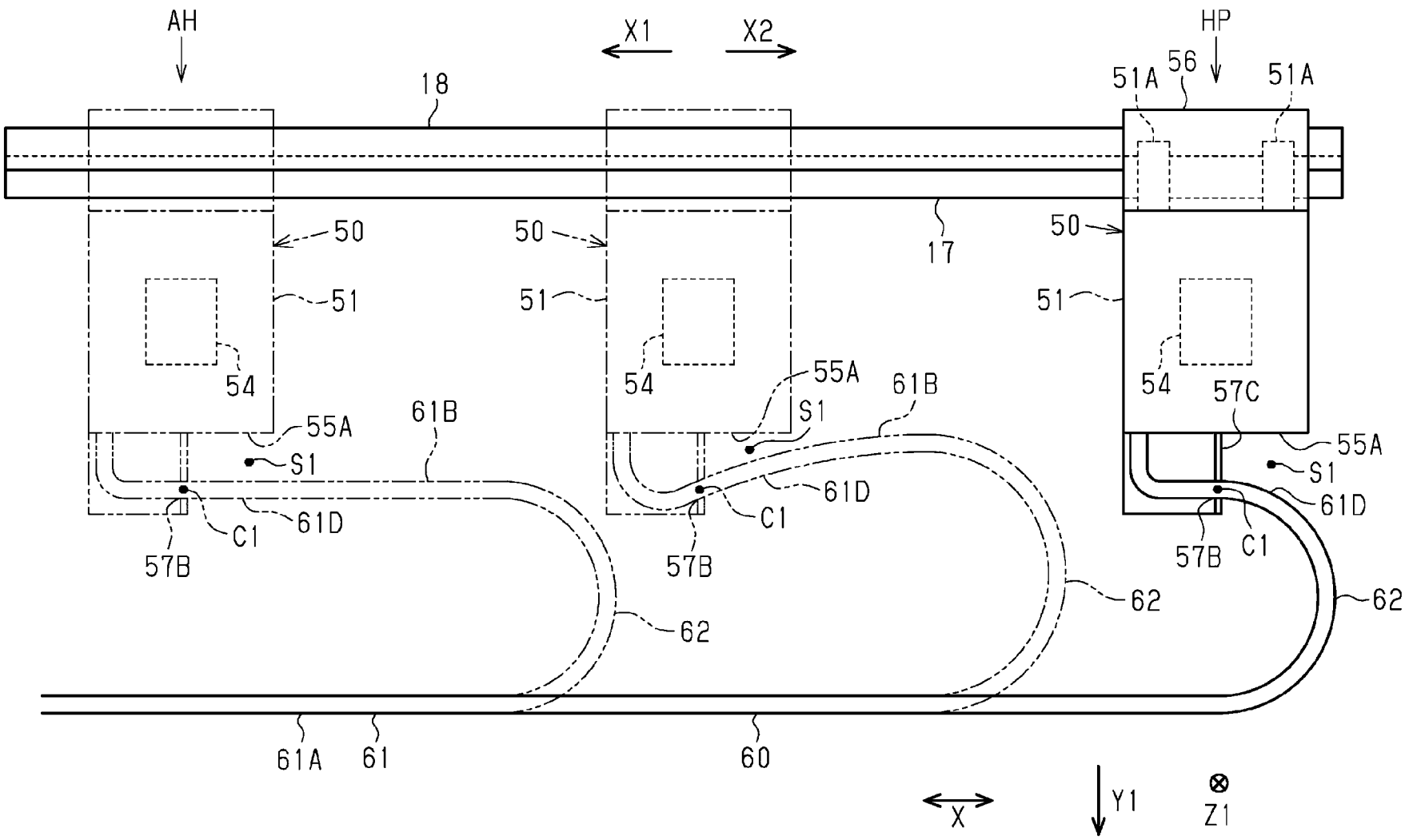
FIG. 7 is a schematic plan view illustrating an operation state of the carriage unit and a state of a change in curving of a tube.

Here, a state of displacement of the curved portion 62 of the tube 61 during the movement process of the carriage unit 50 will be described with reference to FIG. 7. As illustrated in FIG. 7, the tube 61 moves in accordance with movement of the carriage unit 50 in the scanning direction X, and thus the curved portion 62 moves in the same direction of the carriage unit 50 by a movement amount of substantially half the movement amount of the carriage unit 50. In this case, the tube 61 is accompanied by a change in the curvature radius of the curved portion 62.

As illustrated in FIG. 7, the carriage unit 50 waits at the home position HP as an example of a standby position that is one end portion on the movement path when the liquid is not ejected onto the medium M, and is closest to the curved portion 62 when the carriage unit 50 is at the home position HP. When the carriage unit 50 is at the home position HP, the curved portion 62 has a minimum curvature radius.

Further, as illustrated in FIG. 7, as the carriage 51 moves away from the home position HP, the curvature radius of the curved portion 62 increases. When the carriage 51 is positioned at the center portion on the movement path indicated by a two-dot chain line in the drawing, the curvature radius of the curved portion 62 is maximized. When the carriage 51 is at the anti-home position AH indicated by a two-dot chain line in the drawing, the curvature radius of the curved portion 62 is a value between the minimum curvature radius and the maximum curvature radius.

In the present example, the curved portion 62 is positioned on the home position HP side with respect to the coupling start point C1 of the tube 61. Therefore, the space S1 is formed on the home position HP side from the coupling start point C1 of the carriage unit 50. That is, in the carriage unit 50, in a region closer to the home position HP than the coupling start point C1 of the tube 61, the space S1 is formed in which the portion 61D extending from the coupling start point C1 in the tube 61 avoids contact with the carriage unit 50 even if the curved portion 62 is displaced to the maximum curvature radius. In the present example, the coupling start point C1 of the tube 61 is positioned at a downstream end portion of the carriage unit 50 in the transport direction Y1. Therefore, the space S1 is provided at the downstream end portion of the carriage unit 50 in the transport direction Y1, that is, a portion on the home position HP side.

Figure 6:
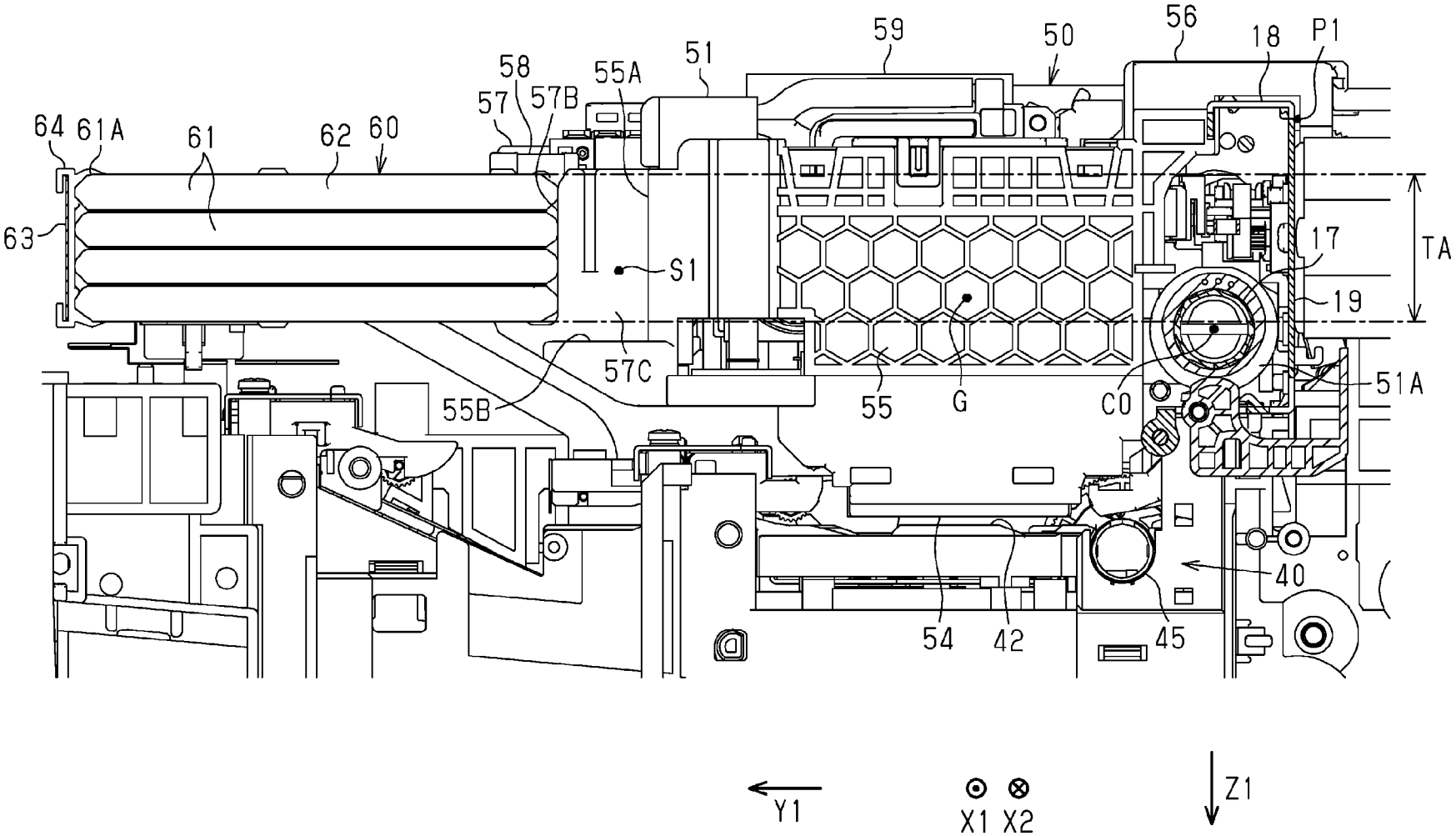
FIG. 6 is a side view of the carriage unit and the periphery thereof viewed from a home position side.

In a plan view viewed from the top to the bottom as illustrated in FIG. 4, the space S1 is provided as a wider region toward the upstream in the transport direction Y1 than an area in which the portion 61D extending from the coupling start point C1 in the tube 61 is displaced in accordance with movement of the carriage unit 50. As illustrated in FIGS. 4 to 6, the space S1 is provided to be recessed by an end surface 55A in the downstream of the carriage unit 50 in the transport direction Y1 and a wall 57C which intersects the end surface 55A and of which a surface extends in a direction approaching the coupling start point C1 from the end surface 55A toward the downstream in the transport direction Y1. That is, the space S1 is formed by a recess portion which is provided to be recessed by the end surface 55A positioned in the upstream of the coupling start point C1 in the transport direction Y1, and the wall 57C extending to the downstream of the end surface 55A in the transport direction Y1, in the vicinity of the coupling start point C1 of the carriage unit 50. In the present example, the regulation portion 57B described above is formed by the recess portion provided in the wall 57C.

In addition, the space S1 has a wide space that does not come into contact the tube 61 at the top and bottom of the tube 61. A lower limit of the space S1 is defined by a surface 55B positioned below the lower end of the tube 61 in the vertical direction Z1. A space, in which the support member 63 and the holding member 64 for preventing the sag do not come into contact with the surface 55B, is also secured in the vertical direction Z1. In the present example, the space S1 is formed of a recess portion that is provided to be recessed in a region on the home position HP side in the scanning direction X from the coupling start point C1 in the carriage unit 50 and in the upstream from the coupling start point C1 in the transport direction Y1. The space S1 is partitioned by a plurality of surfaces forming the recess portion. The space S1 without the surface 55B may be provided.

As illustrated in FIG. 4, the end surface 55A is positioned at a position of a distance L1 from the tube 61 at the coupling start point C1 to the upstream in the transport direction Y1, and the wall 57C is positioned at a position of a distance L2 from a side surface of the carriage unit 50 on the home position HP side in the first direction X1. The first distance L1 is set to a value greater than a maximum displacement distance of the portion 61D extending from the coupling start point C1, which is displaced to the upstream in the transport direction Y1 in accordance with movement of the carriage unit. Thus, the space S1 is provided in an area defined by the second distance L2 from the coupling start point C1 of the carriage 51 toward the home position HP in the scanning direction X and the first distance L1 from the coupling start point C1 toward the upstream in the transport direction Y1.

Therefore, during the movement of the carriage unit 50, even when the curved portion 62 is at the home position HP having the minimum curvature radius illustrated in FIG. 4, or even when the curved portion 62 is at the center position having the maximum curvature radius illustrated in the two-dot chain line in FIG. 7 on the movement path, the portion 61D extending from the coupling start point C1 of the tube 61 is displaced in the space S1 and does not come into contact with the carriage unit 50. Therefore, the portion of the carriage unit 50 that receives the reaction force of the tube 61 is always the coupling start point C1 which is regulated by the regulation portion 57B. Therefore, during the movement process of the carriage unit 50, by the movement position, it is possible to avoid the position change of the location of the carriage unit 50, where the reaction force of the tube 61 is received.

Next, a height position of the tube 61 with respect to the carriage unit 50 will be described with reference to FIG. 6. As illustrated in FIG. 6, the tube 61 is disposed in an area between the both outer ends, in the vertical direction Z1, of the first guide member 17 and the second guide member 18 in the vertical direction Z1. That is, a disposition region TA of the tube 61 in the vertical direction Z1 is positioned within an area between the lower end of the first guide member 17 and the upper end of the second guide member 18. The carriage unit 50 is supported at a support point P1 with respect to the second guide member 18. The disposition region TA of the tube 61 in the vertical direction Z1 is disposed in an area between a shaft C0 of the first guide member 17 and the support point P1 of the second guide member 18 in the vertical direction Z1. Further, the tube 61 is disposed in an area including a part of a sliding portion between the first guide member 17 positioned below the second guide member 18 and the carriage unit 50. The support point P1 does not indicate point contact, and the carriage unit 50 and the second guide member 18 are in line contact or surface contact with each other at the location of the support point P1.

In the present example, the shaft C0 of the first guide member 17 is positioned below and slightly off the disposition region TA of the tube 61. It is desirable that the disposition region TA of the tube 61 includes the shaft C0 of the first guide member 17 that is a main axis. This is because the reaction force of the tube 61 received by the carriage unit 50 can be received by the shaft C0 of the first guide member 17.

However, in the present example, as illustrated in FIG. 6, the tube 61 is disposed in an area including a center of gravity G of the carriage unit 50 in the vertical direction Z1. The carriage unit 50 of the present example stores a plurality of liquid reservoirs 59 in the storage portion 55. The plurality of liquid reservoirs 59 are positioned above the carriage unit 50 in a state in which liquid is reserved. Therefore, the center of gravity G of the carriage unit 50 is shifted upward in the vertical direction Z1 as compared with a configuration in which the liquid reservoir 59 is not mounted. In the present example, the center of gravity G of the carriage unit 50 is positioned above the shaft C0 of the first guide member 17 in the vertical direction Z1. Therefore, in the present example, the disposition region TA of the tube 61 is at a height position that does not include the shaft C0 of the first guide member 17, but at a height position that includes the center of gravity G of the carriage unit 50. Therefore, the reaction force of the tube 61 received by the carriage unit 50 acts on the center of gravity G of the carriage unit 50.

Further, as illustrated in FIG. 7, since the tube 61 has the minimum curvature radius when the carriage unit 50 is at the home position HP, the side wall 12S (see FIG. 1) of the housing 12 on the home position HP side is disposed near the carriage 51 in the home position HP. The width dimension of the liquid ejecting apparatus 11 is relatively small.

The liquid ejecting apparatus 11 includes a controller (not illustrated). The controller controls the carriage motor 52, the liquid ejecting head 54, a transport motor, and the like. The liquid ejecting apparatus 11 is communicably coupled to a host device (not illustrated). The controller performs print control based on print data received from the host device. The host device includes, for example, any one of a personal computer, a personal digital assistant (PDA), a tablet PC, a smartphone, a mobile phone, and the like.

Next, an operation of the liquid ejecting apparatus 11 will be described.

When the liquid ejecting apparatus 11 receives an instruction of printing, the feeder 41 is driven and the medium M fed from the cassette 21 is transported through the transport region FA in the transport direction Y1. Then, while the carriage unit 50 moves in the scanning direction X, a printing operation in which the liquid ejecting head 54 ejects the liquid toward the medium M to perform printing for one scan, and a transport operation in which the medium M is transported by the roller pairs 45 to 47 to the next printing position are alternately performed, and thereby printing onto the medium M is advanced.

As illustrated in FIG. 7, in accordance with movement of the carriage unit 50 in the scanning direction X, the curved portion 62 of the tube 61 moves in the same direction as the carriage unit 50 with a movement amount that is substantially half the movement amount of the carriage unit 50. During the movement of the carriage unit 50, the curvature radius of the curved portion 62 changes.

The carriage unit 50 is closest to the curved portion 62 when the carriage unit 50 is at the home position HP indicated by a solid line in FIG. 7. In this case, the curved portion 62 has the minimum curvature radius.

Further, as illustrated in FIG. 7, as the carriage 51 moves away from the home position HP, the curvature radius of the curved portion 62 increases. When the carriage 51 is positioned at the center portion on the movement path indicated by the two-dot chain line in the drawing, the curvature radius of the curved portion 62 is maximized. When the carriage 51 is at the anti-home position AH indicated by the two-dot chain line in the drawing, the curvature radius of the curved portion 62 is a value between the minimum curvature radius and the maximum curvature radius.

In the present example, the curved portion 62 of the tube 61 is positioned on the home position HP side with respect to the coupling start point C1. The space S1 is formed in which the portion 61D extending from the coupling start point C1 of the tube 61 toward the curved portion 62 can avoid coming into contact with the carriage unit 50 even when the curved portion 62 is displaced to the maximum curvature radius. Therefore, regardless of a position on the movement path along which the carriage unit 50 reciprocates, the portion 61D extending from the coupling start point C1 of the tube 61 does not come into contact with the carriage unit.

For example, in a configuration having no space S1, when the portion 61D extending from the coupling start point C1 of the tube 61 is greatly displaced in the transport direction Y1, the portion 61D comes into contact with the carriage unit 50. In this case, the carriage unit 50 receives the reaction force of the tube 61 not only from the regulation portion 57B that is the coupling start point C1 but also from a location where the portion 61D of the tube 61 comes into contact with the carriage unit 50. That is, the location where the carriage unit 50 receives the reaction force of the tube 61 varies. As a result, the deviation of the posture according to the movement position of the carriage unit 50 is caused. The deviation of the posture of the carriage unit 50 causes a deviation of the liquid ejecting head 54 in the liquid ejecting direction and a variation in sliding resistance with each of the guide members 17 and 18 when the carriage unit 50 moves. The variation in the sliding resistance of the carriage unit 50 causes a variation in a speed of the carriage unit 50. The printing accuracy is decreased due to at least one of the deviation of the liquid ejecting head 54 in the liquid ejecting direction and the variation in the speed of the carriage unit 50.

On the other hand, in the present embodiment, the carriage unit 50 has the space S1 that is wider toward the upstream in the transport direction Y1 than an area in which the portion 61D, which extends from the coupling start point of the tube 61 with respect to the carriage unit 50 toward the curved portion 62, is displaced in accordance with movement of the carriage unit 50. Therefore, even if the portion 61D of the tube 61 extending from the coupling start point C1 is displaced in accordance with the movement of the carriage unit 50, the displacement is settled by the displacement in the space S1, and the portion 61D does not come into contact with the carriage unit 50. That is, the reaction force of the tube 61 is always received by the regulation portion 57B regardless of the position of the carriage unit 50 on the movement path. As a result, the deviation of the posture of the carriage unit 50 caused by the change in the location where the reaction force of the tube 61 is received can be suppressed. It is possible to suppress the deviation of the liquid ejecting head 54 in the liquid ejecting direction and the variation in the speed of the carriage unit 50 due to the deviation of the posture of the carriage unit 50. Therefore, a decrease in printing accuracy due to the reaction force of the tube 61 received by the carriage unit 50 is suppressed.

As illustrated in FIGS. 4 and 5, the regulation portion 57B that regulates the tube 61 at the coupling start point C1 is positioned at the center portion of the width of the carriage unit 50. The center portion does not mean the center, but includes a region deviated from the center. Therefore, the carriage unit 50 always receives the reaction force of the tube 61 at the center portion in the scanning direction X. That is, since the carriage unit 50 receives the reaction force of the tube 61 between the pair of coupling portions 51A in the scanning direction X, a deviation of the rotation of the carriage unit 50 around the Z-axis is unlikely to occur. Therefore, a decrease in printing accuracy due to the deviation of the posture of the carriage unit 50 can be more effectively suppressed.

As illustrated in FIG. 6, the tube 61 is disposed in an area, in the vertical direction Z1, between the both outer ends of the first guide member 17 and the second guide member 18 in the vertical direction Z1. Therefore, the carriage unit 50 receives the reaction force of the tube 61 between the both outer ends of the first guide member 17 and the second guide member 18 in the vertical direction Z1. Further, the tube 61 is disposed in an area including a part of a sliding portion between the first guide member 17 and the carriage unit 50. Therefore, the reaction force of the tube 61 received by the carriage unit 50 is received by the first guide member 17. As a result, the deviation of the rotation around the X-axis about the shaft C0 of the guide member 17 of the carriage unit 50 is unlikely to occur.

As illustrated in FIG. 6, since the carriage unit 50 includes the liquid reservoir 59 in the upper portion, the center of gravity G of the carriage unit 50 is higher than that of a configuration having no liquid reservoir 59. In the present example, the disposition region TA of the tube 61 is at a height position that does not include the shaft C0 of the first guide member 17, but is at a height position that includes the center of gravity G of the carriage unit 50. Therefore, the reaction force of the tube 61 acts on the center of gravity G of the carriage unit 50. Therefore, the deviation of the rotation around the X-axis about the shaft C0 of the first guide member 17 of the carriage unit 50 is unlikely to occur.

As illustrated in FIGS. 4, 5, and 7, the carriage unit 50 is closest to the curved portion 62 when the carriage unit 50 is at the home position HP that is the standby position when no liquid is ejected onto the medium M. Therefore, when jam of the medium M occurs and the carriage unit 50 is in a state of returning to the home position HP, the curved portion 62 is positioned on the opposite side of the transport region FA with respect to the carriage unit 50 and is not positioned in the transport region FA. Therefore, the tube 61 does not get in the way when maintenance work is performed to eliminate the jam of the medium M.

The space S1 is formed on the home position HP side of the carriage unit 50. Therefore, when the carriage unit 50 is at the home position HP, the curvature radius of the curved portion 62 is reduced, and a part of the portion 61D of the tube 61, which enters the space S1, is also curved. As a result, a part of the curved portion 62 enters the space S1. The position of the side wall 12S of the housing 12 of the liquid ejecting apparatus 11 on the home position HP side can be disposed near the carriage unit 50 when the carriage unit 50 is at the home position HP. Therefore, the width size of the liquid ejecting apparatus 11 can be reduced by shortening the width dimension of the housing 12.

Further, the space S1 is provided to be recessed in the carriage unit 50 by the end surface 55A of the carriage unit 50 in the downstream in the transport direction Y1 intersecting the scanning direction X, and the wall 57C which intersects the end surface 55A and of which the surface extends in a direction approaching the coupling start point C1 from the end surface 55A toward the downstream in the transport direction Y1. Therefore, even if the portion 61D extending from the coupling start point C1 is displaced when the carriage unit 50 moves, the portion 61D does not come into contact with the end surface 55A.

Further, when double-sided printing is performed on the medium M, the medium M where printing is finished on the first surface is discharged by the transport roller pair 45 and the two discharge roller pairs 46 and 47 in the first transport direction Y1 along the first transport path K1, and then is transported by switchback that is drawn back in the second transport direction Y2, and is drawn into the second transport path K2. The medium M reversely transported through the second transport path K2 is reversed by passing through an outer periphery of an intermediate roller which constitutes the feeder 41, and is fed again toward the liquid ejecting head 54, using the second surface as a surface to be printed, which is a surface opposite to the printed first surface. Double-sided printing is performed by printing on the second surface of the medium M. The medium M on which the double-sided printing is finished is discharged from the discharge port 15 and stacked on the discharge tray 22. As described above, in the present embodiment, the second discharge roller pair 47 is provided which is used to cause the medium M to transport to be switched back to the downstream position of the first discharge roller pair 46 in the transport direction Y1, and to be drawn into the second transport path K2. Therefore, in the housing 12, a relatively long space in the transport direction Y1 is secured in a downstream area of the movement path of the carriage unit 50 in the transport direction Y1, that is, above the second discharge roller pair 47 in the transport direction Y1.

The tube 61 is routed by using the space above the second discharge roller pair 47, in a state in which the curved portion 62 is positioned above the second discharge roller pair 47. Therefore, the coupling start point C1 of the tube 61 can be set at the downstream end portion of the carriage unit 50 in the transport direction Y1. Therefore, since the storage portion 55 is not used for the coupling space of the tube 61, a plurality of liquid reservoirs 59 can be stored in the storage portion 55. Therefore, by reserving a predetermined amount of the liquid in the liquid reservoir 59, for example, reduction of a drive frequency of the pump in the mounting portion 29 can be realized, or occurrence of a problem such as a variation in an ejecting amount of the liquid caused by a shortage of the amount of the liquid supplied to the liquid ejecting head 54 can be suppressed.

According to the embodiment described above, the following effects can be obtained.

(1) The liquid ejecting apparatus 11 includes the liquid ejecting head 54 that ejects the liquid onto the medium M, and the carriage unit 50 that reciprocates in the scanning direction of the liquid ejecting head 54. Further, the liquid ejecting apparatus 11 includes the liquid container 28 capable of storing the liquid supplied to the liquid ejecting head 54 and provided at a position different from a position where the carriage unit 50 is disposed. In addition, the liquid ejecting apparatus 11 includes the tube 61 that supplies the liquid sent from the liquid container 28 to the carriage unit 50. When the carriage unit 50 reciprocates, in a case in which one direction is referred to as the first direction X1, and the other direction is referred to as the second direction X2, the tube 61 extends from the liquid container 28 in the second direction X2, and then forms the curved portion 62 curving toward the upstream in the transport direction Y1 of the medium M. The tube 61 is folded back in the first direction X1 to be coupled to the carriage unit 50. The carriage unit 50 has the space S1 that expands in the transport direction Y1 upstream of the area in which the portion 61D, which extends from the coupling start point C1 of the tube 61 with respect to the carriage unit 50 toward the curved portion 62, is displaced in accordance with movement of the carriage unit 50. Therefore, even if the portion 61D of the tube 61 extending from the coupling start point C1 is displaced with respect to the carriage unit 50 according to the movement of the carriage unit 50, the displacement is settled by the displacement in the space S1, and the portion 61D does not come into contact with the carriage unit 50. Therefore, the reaction force of the tube 61 is always received by the coupling start point C1 regardless of the position of the carriage unit 50 on the movement path. Therefore, the deviation of the posture of the carriage unit 50 caused by the change in the location where the reaction force of the tube is received can be suppressed. As a result, a decrease in printing accuracy can be suppressed.

(2) The carriage unit 50 includes the regulation portion 57B that regulates the tube 61 at the coupling start point C1. The regulation portion 57B is positioned at the center portion of the carriage unit 50 in the scanning direction X. Therefore, since the carriage unit 50 always receives the reaction force of the tube 61 at the center portion in the scanning direction X, the deviation of the posture of the carriage unit 50 is unlikely to occur compared to a configuration in which the reaction force of the tube 61 is received at a portion other than the center portion, for example, the end portion or the like. Therefore, a decrease in printing accuracy due to the deviation of the posture of the carriage unit 50 can be more effectively suppressed.

(3) The carriage unit 50 waits at the home position HP that is one end portion in the movement path when the liquid is not ejected onto the medium M, and is closest to the curved portion 62 when the carriage unit 50 is at the home position HP. Therefore, when the carriage unit 50 is at the home position HP, the curved portion 62 is positioned on the opposite side of the transport region FA in the scanning direction X and is not positioned in the transport region FA. Therefore, in a state in which the carriage unit 50 is at the home position HP, the tube 61 does not get in the way when a user performs maintenance work to eliminate the jam of the medium M.

(4) The space S1 is formed on the home position HP side from the coupling start point C1 of the carriage unit 50. Therefore, it is possible to avoid that the portion 61D extending in the direction from the coupling start point C1 of the tube 61 toward the home position HP comes into contact with the carriage unit 50 during the movement of the carriage unit 50. When the carriage unit 50 is at the home position HP, the curvature radius of the curved portion 62 is reduced, and a part of the curved portion 62 enters the space S1. Therefore, the position of the side wall 12S of the housing 12 of the liquid ejecting apparatus 11 on the home position HP side can be disposed near the carriage unit 50 when the carriage unit 50 is at the home position HP. Therefore, the width size of the liquid ejecting apparatus 11 can be reduced.

(5) The space S1 is provided to be recessed by the end surface 55A in the downstream in the transport direction Y1 intersecting the scanning direction X of the carriage unit 50, and the wall 57C which intersects the end surface 55A and of which the surface extends in a direction approaching the coupling start point C1 from the end surface 55A toward the downstream in the transport direction Y1. Therefore, since the end surface 55A is positioned in the upstream of the coupling start point C1 of the tube 61 in the transport direction Y1, even if the tube 61 is displaced during the movement of the carriage unit 50, the tube 61 does not come into contact with the end surface 55A.

(6) The first guide member 17 and the second guide member 18 are provided which guide the carriage unit 50 in the scanning direction X at a position on the opposite side of the tube 61 in the transport direction Y1 and are respectively disposed at differ positions in the vertical direction Z1. The tube 61 is disposed in an area, in the vertical direction Z1, between the both outer ends of the first guide member 17 and the second guide member 18 in the vertical direction Z1. Therefore, since the reaction force of the tube 61 is received in the area between the both outer ends of the first guide member 17 and the second guide member 18 in the vertical direction Z1, the deviation of the rotation around the X-axis about the shaft C0 of the first guide member 17 of the carriage unit 50 is unlikely to occur. Therefore, a decrease in printing accuracy can be suppressed.

(7) The tube 61 is disposed in an area including a part of the sliding portion between the first guide member 17 positioned below the second guide member 18 and the carriage unit 50. The force from the carriage unit 50 that receives the reaction force of the tube 61 is received by the first guide member 17 at the sliding portion, so that the deviation of the rotation around the X-axis about the shaft C0 of the first guide member 17 of the carriage unit 50 is unlikely to occur. Therefore, a decrease in printing accuracy can be suppressed.

(8) The carriage unit 50 includes the liquid reservoir 59 that reserves the liquid supplied through the tube 61, at the top. The tube 61 is disposed in the area including the center of gravity G of the carriage unit 50 in the vertical direction Z1. Thus, the reaction force of the tube 61 acts on the center of gravity G of the carriage unit 50. Therefore, the deviation of the rotation around the X-axis about the shaft C0 of the guide member 17 of the carriage unit 50 is unlikely to occur. Therefore, a decrease in printing accuracy can be suppressed.

(9) The tube 61 is routed in a state in which the curved portion 62 is positioned above the second discharge roller pair 47. Therefore, the tube 61 can be routed using the space above the second discharge roller pair 47.

(10) Since the deviation of the posture of the carriage unit 50 can be suppressed by (1) to (8) described above, in the carriage unit 50, it is possible to realize elimination of the urging mechanism for urging the carriage unit 50 with respect to the first guide member 17 by the spring in each direction of the X-axis, Y-axis, and Z-axis, elimination of the spring in at least one axis, or reduction of a set urging force of the spring. As a result, it is possible to reduce the sliding resistance during the movement of the carriage unit 50 due to the urging force of the urging mechanism. Therefore, it is possible to suppress the deviation of the posture of the carriage unit 50 due to the sliding resistance. Also from this point, it is possible to further suppress a decrease in printing accuracy due to the deviation of the posture of the carriage unit 50. Further, it is possible to reduce wear of the first guide member 17 due to the urging mechanism.

Second Embodiment

Next, a second embodiment will be described with reference to FIG. 8. In the second embodiment, a disposition height of a tube 61 with respect to a carriage unit 50 is different from that of the first embodiment. Other configurations are the same as those of the first embodiment.

Figure 8:
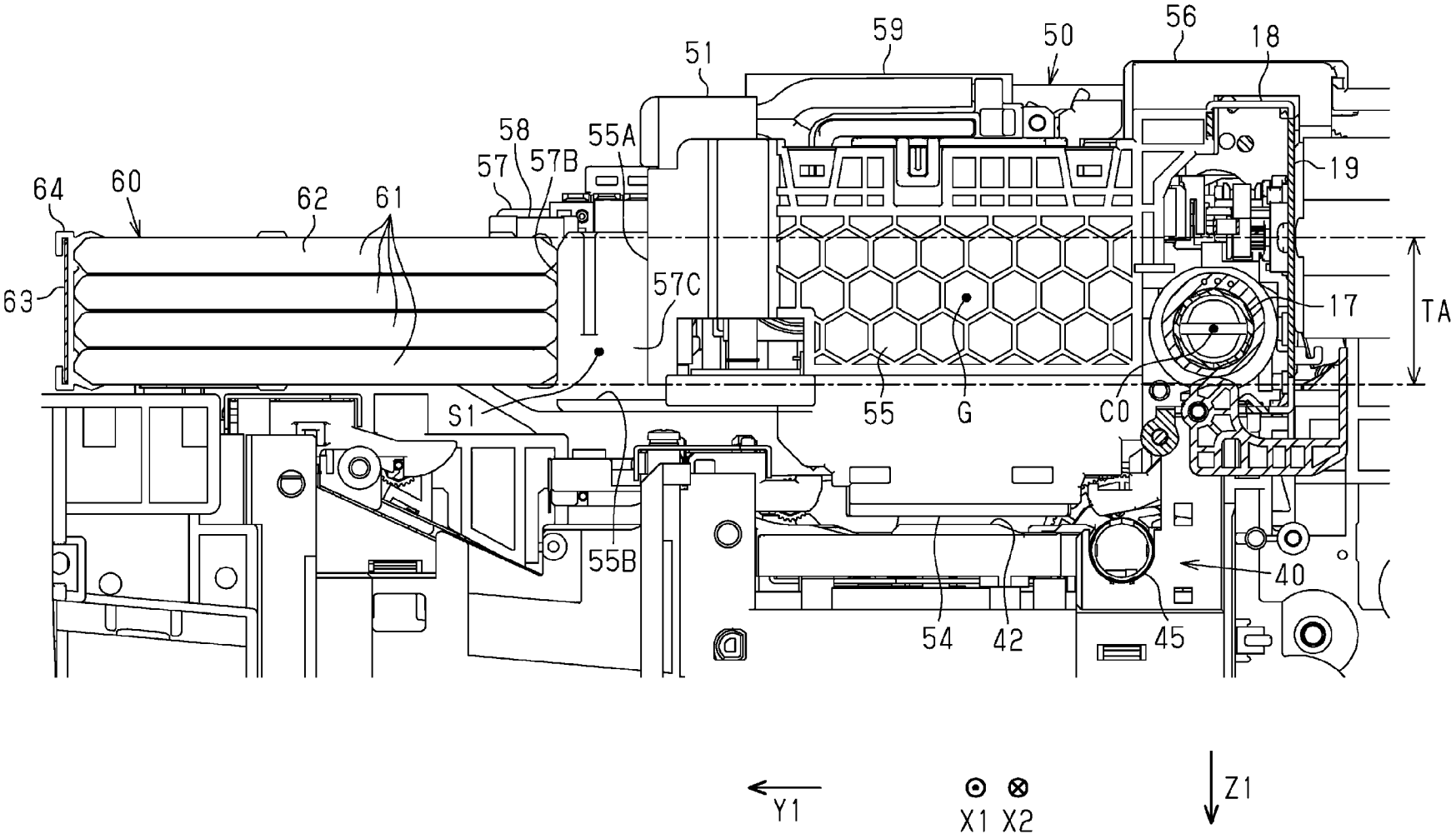
FIG. 8 is a side view of a carriage unit and a periphery thereof according to a second embodiment, viewed from a home position side.

As illustrated in FIG. 8, a tube disposition region TA is positioned slightly lower than that in the first embodiment in the vertical direction Z1. Therefore, the disposition region TA of the tube 61 is disposed in an area including a shaft C0 of a first guide member 17 positioned below a second guide member 18. Further, the tube 61 is disposed in an area including an entire sliding portion between the first guide member 17 and the carriage unit 50. In the present example, the disposition region TA in which a plurality of tubes 61 constituting a tube bundle 60 are aligned in a line in the vertical direction Z1 is disposed in an area including the entire sliding portion between the first guide member 17 and the carriage unit 50.

According to the second embodiment, the effects (1) to (10) in the first embodiment can be obtained similarly, and the following effects can be obtained.

(11) The tube 61 is disposed in an area including the shaft C0 of the first guide member 17. Therefore, a force from the carriage unit 50 that receives a reaction force of the tube 61 is received by the first guide member 17 at the shaft C0, so that a rotational moment about the shaft C0 is unlikely to occur in the carriage unit 50. A deviation of the rotation around the X-axis about the shaft C0 of the first guide member 17 of the carriage unit 50 is unlikely to occur. Therefore, a decrease in printing accuracy can be suppressed. In the present embodiment, the tube 61 is disposed in an area including the entire sliding portion between the first guide member 17 and the carriage unit 50. Therefore, the effect (7) in the first embodiment can be obtained more effectively.

Third Embodiment

Next, a third embodiment will be described with reference to FIGS. 9 and 10. In the third embodiment, a structure in which a tube 61 is routed with respect to a carriage unit 50 is different from that in each of the embodiments described above. That is, a coupling start point C1 of the tube 61 is positioned in a storage portion 55 of the carriage unit 50.

Figure 9:
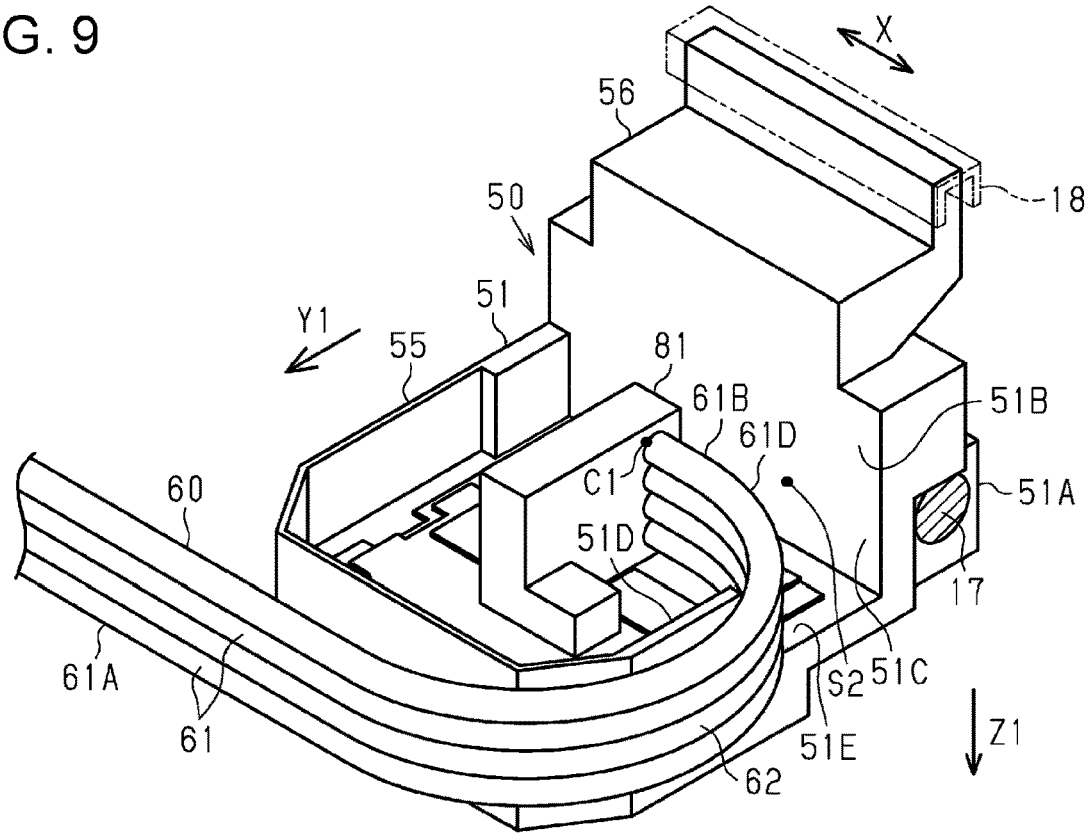
FIG. 9 is a perspective view of a carriage unit according to a third embodiment.
Figure 10:
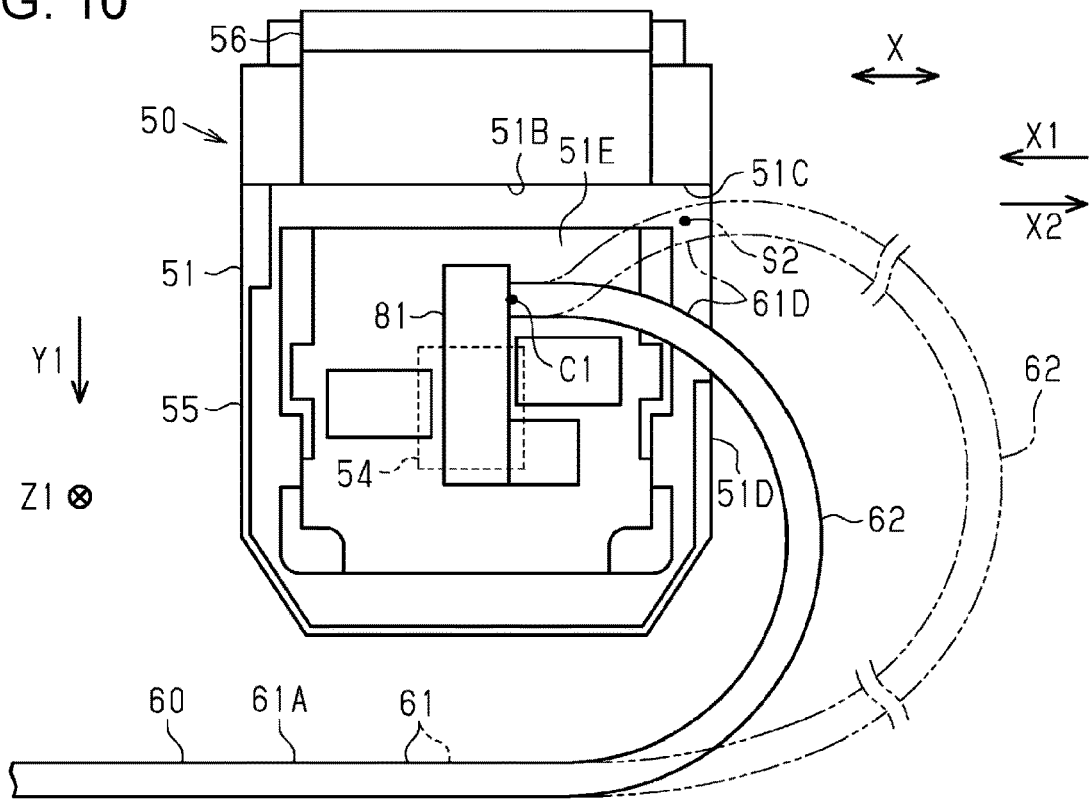
FIG. 10 is a schematic plan view illustrating the carriage unit and a periphery thereof.

As illustrated in FIGS. 9 and 10, a plurality of tubes 61 constituting a tube bundle 60 are disposed side by side in a vertical direction Z1, and the tube bundle 60 includes a first straight portion 61A, a curved portion 62, and a second straight portion 61B. In the curved portion 62, the tube 61 is curved in the horizontal direction so as to be folded back on the way from the first straight portion 61A to the second straight portion 61B. The carriage unit 50 includes a carriage 51 guided in a scanning direction X by a first guide member 17 and a second guide member 18, and a liquid ejecting head 54 (see FIG. 10) mounted on a lower portion of the carriage 51. A joint member 81 is assembled in a storage portion 55 of the carriage 51. The joint member 81 has a plurality of pipe portions (not illustrated) that horizontally protrude from a side surface thereof, and a tip portion of each of the plurality of tubes 61 is extrapolated to each of the plurality of pipe portions. Therefore, the tip portions of the plurality of tubes 61 are coupled to the joint member 81. Since the tip portion of the tube 61 is regulated by being extrapolated to the pipe portion of the joint member 81, in the present embodiment, the joint member 81 corresponds to an example of a regulation portion.

In the first embodiment or the like, the tube 61 is coupled to the downstream end portion of the carriage unit 50 in the transport direction Y1, and the coupling start point C1 is positioned at the downstream end portion, whereas, in the third embodiment, the coupling start point C1 of the tube 61 is positioned in the storage portion 55 in which the joint member 81 which is a coupling destination of the tube 61 was stored. That is, the coupling start point C1 is positioned in the upstream from the downstream end portion of the carriage unit 50 by a predetermined distance. Therefore, a distance between the downstream end portion of the carriage unit 50 and the first straight portion 61A in the transport direction Y1 is shorter than that in the configuration of the first embodiment.

As illustrated in FIGS. 9 and 10, a space S2 is formed in the storage portion 55 of the carriage unit 50. The space S2 that expands in the transport direction Y1 upstream of an area (see FIG. 10) in which the portion 61D, which extends from the coupling start point C1 toward the curved portion 62, is displaced while the carriage unit moves. A width of the space S2 in the upstream in the transport direction Y1 is defined by a wall surface 51B. The wall surface 51B is formed at a position at which a distance from the coupling start point C1 to the wall surface 51B toward the upstream in the transport direction Y1 is longer than a displacement amount of the portion 61D from the coupling start point C1 to the upstream in the transport direction Y1 when the curved portion 62 indicated by a two-dot chain line in FIG. 10 has a maximum curvature radius. An opening portion 51C that is wide enough not to come into contact with the carriage unit 50, even when the portion 61D of the tube 61 is displaced to the maximum, is open in the side wall 51D of the storage portion 55 on the curved portion 62 side. Further, the portion 61D of the tube 61 is positioned, in the vertical direction Z1, above a bottom surface 51E of the storage portion 55 or a storage material such as a plate material including a substrate assembled on the bottom surface 51E. The space S2 is formed to be horizontally recessed inwardly on the side wall 51D on the home position HP side (right side in FIG. 10) of the carriage unit 50 and is formed by a recess portion partitioned by the wall surface 51B and the bottom surface 51E.

A routing structure of the tube 61 of the present embodiment can be applied to the liquid ejecting apparatus 11 including the second discharge roller pair 47 as that in the first embodiment, and can also be applied to the liquid ejecting apparatus 11 not including the second discharge roller pair 47. In the liquid ejecting apparatus 11 that does not include the second discharge roller pair 47, it is difficult to secure a wide space in which the tube 61 is routed in a downstream area in the transport direction Y1 from the movement path of the carriage unit 50 in the housing 12. On the other hand, in the configuration illustrated in FIGS. 9 and 10, while the curved portion 62 has the same curvature radius as that of the first embodiment, the tube 61 can be routed in the downstream area in the transport direction Y1 from the movement path of the carriage unit 50.

In the third embodiment, the disposition region TA of the tube 61 in the vertical direction Z1 is disposed in an area between the both outer ends of the first guide member 17 and the second guide member 18 in the vertical direction Z1. Further, the disposition region TA of the tube 61 is set in an area including the center of gravity G of the carriage unit and the shaft C0 of the first guide member 17. Also in the liquid ejecting apparatus adopting the routing structure of the tube 61 illustrated in the third embodiment, the effects of (1) to (7), and (10) in the first embodiment, and (11) in the second embodiment are obtained similarly.

In addition, the embodiments can also be changed into a form like modifications illustrated below. Furthermore, a combination of the embodiments described above and the modifications illustrated below can be appropriately used as a further modification, and a combination of the modifications illustrated below can be appropriately used as a further modification.

A routing structure of the tube 61 may be adopted in which the curved portion 62 of the tube 61 is disposed on an anti-home position AH side of the carriage unit 50. For example, in each of the embodiments described above, the home position HP and the anti-home position AH are set at positions opposite to each other, the liquid container 28 is disposed at a position opposite to that in the embodiments described above in the scanning direction X, and a routing path of the tube 61 is laid out right and left symmetrical in the scanning direction X with respect to those in the embodiments described above. In such a case, the carriage unit 50 is provided with the space S1 that expands in the transport direction Y1 upstream of an area in which the portion 61D that is a portion extending from the coupling start point C1 of the tube 61 toward the curved portion 62 is displaced. Therefore, the same effects as those of the embodiments described above can be obtained.

The coupling start point C1 and the regulation portion of the tube 61 may be disposed in a portion other than the center portion of the carriage unit 50 in the scanning direction X. For example, a configuration may be adopted in which the coupling start point C1 and the regulation portion are disposed at the end portion near an side end of the carriage unit 50 in the second direction X2 slightly away from the first direction X1, and the portion 61D extends from the coupling start point C1 in the second direction X2. Further, a configuration may be adopted in which the coupling start point C1 and the regulation portion are disposed at the end portion near an side end of the carriage unit 50 in the first direction X1 slightly away from the second direction X2, and the portion 61D extends from the coupling start point C1 in the second direction X2. In particular, in the latter configuration, when the carriage unit 50 is at the home position HP, it is possible to secure a large amount of a part of the curved portion 62, which enters the space S1, so that the liquid ejecting apparatus 11 can be further reduced in width size.

In the embodiments described above, the first guide member 17 may be replaced with a guide shaft, and a rail portion formed by a part of the main frame 19 may be used. The second guide member 18 may be used as a guide shaft.

The tube 61 is not limited to the tube bundle configuration in which the plurality of tubes are bundled, and may have a configuration having only one tube. For example, the present disclosure may be applied to a configuration including one tube 61 in the liquid ejecting apparatus 11 that performs printing in one color of black.

In each embodiment described above, one discharge roller pair may be provided. The discharge roller pair may be a plurality of three or more.

The medium M is not limited to the sheet, but may be a flexible plastic film, cloth, nonwoven fabric, or the like.

The liquid ejecting apparatus 11 is not limited to a printing apparatus that performs printing on a sheet or film as a medium, and may be a textile printing apparatus that performs printing on a cloth.

The liquid ejecting apparatus is not limited to a serial printer in which the carriage unit 50 moves in the scanning direction X, and may be a lateral printer in which the carriage unit 50 can move in two directions of the main scanning direction and the sub-scanning direction.

The liquid ejecting apparatus is not limited to a printer for printing. For example, a liquid material in which particles of a functional material are dispersed or mixed in a liquid is ejected, and an electric wiring pattern or pixels of various types of display such as liquid crystal, electroluminescence (EL), and surface emission may be manufactured on a substrate which is an example of a medium. Furthermore, a liquid ejecting apparatus may be provided for three-dimensional modeling for forming a three-dimensional object by ejecting an uncured resin liquid.

The technical idea grasped from the embodiments and the modifications will be described below together with operational effects thereof.

The liquid ejecting apparatus includes a carriage unit that includes a liquid ejecting head ejecting liquid onto a medium and reciprocates in a scanning direction of the liquid ejecting head; a liquid container configured to store the liquid to be supplied to the liquid ejecting head and provided at a position different from a position where the carriage unit is disposed; and a tube that supplies the liquid sent from the liquid container to the carriage unit. When the carriage unit reciprocates, in a case in which one direction is referred to as a first direction and another direction is referred to as a second direction, the tube extends from the liquid container in the second direction, forms a curved portion curving toward upstream in a transport direction of the medium, is folded back in the first direction, and is coupled to the carriage unit. The carriage unit includes a space that expands in the transport direction upstream of an area in which a part of the tube extending from a coupling start point of coupling the tube to the carriage unit toward the curved portion is displaced in accordance with movement of the carriage unit According to this configuration, even if a part of the tube extending from the coupling start point to the carriage unit is displaced in accordance with movement of the carriage unit, the displacement is settled by the displacement in the space and the tube does not come into contact with the carriage unit. Therefore, the reaction force of the tube is always received by the coupling start point regardless of the position of the carriage unit in the movement path. Therefore, the deviation of the posture of the carriage unit caused by the change in the location where the reaction force of the tube is received can be suppressed. As a result, a decrease in printing accuracy can be suppressed.

In the liquid ejecting apparatus, the carriage unit may have a regulation portion that regulates the tube at the coupling start point, and the regulation portion may be positioned at a center portion of the carriage unit in a scanning direction.

According to this configuration, since the carriage unit always receives the reaction force of the tube at the center portion in the scanning direction, the deviation of the posture of the carriage unit is unlikely to occur compared to a configuration in which the reaction force of the tube is received at a portion other than the center portion, for example, the end portion or the like. Therefore, a decrease in printing accuracy due to the deviation of the posture of the carriage unit can be more effectively suppressed.

In the liquid ejecting apparatus, when liquid is not ejected onto a medium, the carriage unit may wait at a standby position in one end of a movement path, and when the carriage unit is at the standby position, the carriage unit may be closest to the curved portion.

According to this configuration, when the carriage unit is at the standby position, the curved portion is positioned on the opposite side of the transport region and is not positioned in the transport region in the scanning direction. Therefore, the tube does not get in the way when the user performs maintenance work to eliminate the jam of the medium.

In the liquid ejecting apparatus, the space may be formed close to the standby position relative to the coupling start point of the carriage unit.

According to this configuration, it is possible to avoid that a part of the tube extending in a direction from the coupling start point toward the standby position comes into contact with the carriage unit during the movement of the carriage unit. In addition, when the carriage unit is at the standby position, the curvature radius of the curved portion is reduced, and a part of the curved portion enters the space. Therefore, the position of the side wall of the housing of the liquid ejecting apparatus on the standby position side can be disposed near the carriage unit when the carriage unit is at the standby position. Therefore, the width size of the liquid ejecting apparatus can be reduced.

In the liquid ejecting apparatus, the space may be provided to be recessed by an end surface of the carriage unit downstream in the transport direction intersecting the scanning direction and a wall which intersects the end surface and of which a surface extends from the end surface toward downstream in the transport direction to approach the coupling start point.

According to this configuration, since the end surface forming the space in the carriage unit is positioned in the upstream of the coupling start point in the transport direction, even if the tube is displaced during the movement of the carriage unit, the tube does not contact the end surface.

The liquid ejecting apparatus may further include a first guide member and a second guide member that guide the carriage unit in the scanning direction at positions opposite to the tube in the transport direction, and are disposed at positions different from each other in the vertical direction, and the tube may be disposed in an area between both outer ends of the first guide member and the second guide member in the vertical direction.

According to this configuration, since the reaction force of the tube is received in the area between the both outer ends of the first guide member and the second guide member in the vertical direction, the deviation of the rotation about the guide members of the carriage unit is unlikely to occur. Therefore, a decrease in printing accuracy can be suppressed.

In the liquid ejecting apparatus, the first guide member may be positioned below the second guide member, and the tube may be disposed in an area including a part or entirety of a sliding portion between the first guide member and the carriage unit.

According to this configuration, the force from the carriage unit that receives the reaction force of the tube is received by the first guide member at the sliding portion, so that the deviation of the rotation around the axis of the first guide member of the carriage unit is unlikely to occur. Therefore, a decrease in printing accuracy can be suppressed.

In the liquid ejecting apparatus, the tube may be disposed in an area including a shaft of the first guide member in the vertical direction.

According to this configuration, the force from the carriage unit that receives the reaction force of the tube is received by the first guide member at the shaft, so that a rotational moment about the shaft is unlikely to occur in the carriage unit. The deviation of the rotation around the axis of the first guide member of the carriage unit is unlikely to occur. Therefore, a decrease in printing accuracy can be suppressed.

In the liquid ejecting apparatus, the carriage unit may include a liquid reservoir reserving the liquid supplied through the tube, at an upper portion thereof, and the tube may be disposed in an area including the center of gravity of the carriage unit in the vertical direction.

According to this configuration, since the reaction force of the tube acts on the center of gravity of the carriage unit, the deviation of the rotation about the axis of the guide member of the carriage unit is unlikely to occur. Therefore, a decrease in printing accuracy can be suppressed.

The liquid ejecting apparatus may further include a transport section that transports a medium onto which liquid is ejected from the liquid ejecting head. The transport section may include a first discharge roller pair at a position downstream of the liquid ejecting head in the transport direction, and a second discharge roller pair positioned downstream of the first discharge roller pair in the transport direction. The tube may be routed in a state in which the curved portion is positioned above the second discharge roller pair.

According to this configuration, the tube can be routed using the space above the second discharge roller pair.

What is claimed is:

1. A liquid ejecting apparatus comprising:

a carriage unit that includes a liquid ejecting head ejecting liquid onto a medium and reciprocates in a scanning direction of the liquid ejecting head;

a liquid container configured to store the liquid to be supplied to the liquid ejecting head and provided at a position different from a position where the carriage unit is disposed; and a tube that supplies the liquid sent from the liquid container to the carriage unit, wherein when the carriage unit reciprocates, in a case in which one direction is referred to as a first direction and another direction is referred to as a second direction, the tube extends from the liquid container in the second direction, forms a curved portion curving toward upstream in a transport direction of the medium, is folded back in the first direction, and is coupled to the carriage unit, and the carriage unit includes a space that expands in the transport direction upstream of an area in which a part of the tube extending from a coupling start point of coupling the tube to the carriage unit toward the curved portion is displaced in accordance with movement of the carriage unit, wherein the part of the tube is displaced in the space by moving into and out of the space during the movement of the carriage unit such that a distance between the part of the tube and the carriage unit is changeable based on a location of the carriage while the carriage reciprocates, and wherein as the part of the tube is displaced in the space by moving into and out of the space during the movement of the carriage unit, the part of the tube does not come into contact with the carriage unit.

2. The liquid ejecting apparatus according to claim 1, wherein the carriage unit has a regulation portion that regulates the tube at the coupling start point, and the regulation portion is positioned at a center portion of the carriage unit in a scanning direction.

3. The liquid ejecting apparatus according to claim 1, wherein when liquid is not ejected onto a medium, the carriage unit waits at a standby position in one end of a movement path, and when the carriage unit is at the standby position, the carriage unit is closest to the curved portion.

4. The liquid ejecting apparatus according to claim 3, wherein the space is formed close to the standby position relative to the coupling start point of the carriage unit.

5. The liquid ejecting apparatus according to claim 1, wherein the space is provided to be recessed by an end surface of the carriage unit downstream in the transport direction and a wall which intersects the end surface and of which a surface extends from the end surface toward downstream in the transport direction to approach the coupling start point.

6. The liquid ejecting apparatus according to claim 1, further comprising a first guide member and a second guide member that guide the carriage unit in the scanning direction at positions opposite to the tube in the transport direction, and are disposed at positions different from each other in a vertical direction, wherein the tube is disposed in an area between both outer ends of the first guide member and the second guide member in the vertical direction.

7. The liquid ejecting apparatus according to claim 6, wherein the first guide member is positioned below the second guide member, and the tube is disposed in an area including a part or entirety of a sliding portion between the first guide member and the carriage unit.

8. The liquid ejecting apparatus according to claim 7, wherein the tube is disposed in an area including a shaft of the first guide member in the vertical direction.

9. The liquid ejecting apparatus according to claim 1, wherein the carriage unit includes a liquid reservoir reserving the liquid supplied through the tube, at an upper portion thereof, and the tube is disposed in an area including a center of gravity of the carriage unit in a vertical direction.

10. The liquid ejecting apparatus according to claim 1, further comprising a transport section that transports a medium onto which liquid is ejected from the liquid ejecting head, wherein the transport section includes a first discharge roller pair at a position downstream of the liquid ejecting head in the transport direction, and a second discharge roller pair positioned downstream of the first discharge roller pair in the transport direction, and the tube is routed in a state in which the curved portion is positioned above the second discharge roller pair.

11. A liquid ejecting apparatus comprising:

a carriage unit that includes a liquid ejecting head ejecting liquid onto a medium and reciprocates in a scanning direction of the liquid ejecting head;

a liquid container configured to store the liquid to be supplied to the liquid ejecting head and provided at a position different from a position where the carriage unit is disposed; and a tube that supplies the liquid sent from the liquid container to the carriage unit, wherein when the carriage unit reciprocates, in a case in which one direction is referred to as a first direction and another direction is referred to as a second direction, the tube extends from the liquid container in the second direction, forms a curved portion curving toward upstream in a transport direction of the medium, is folded back in the first direction, and is coupled to the carriage unit, and the carriage unit includes a space that expands in the transport direction upstream of an area in which a part of the tube extending from a coupling start point of coupling the tube to the carriage unit toward the curved portion is displaced in accordance with movement of the carriage unit, wherein the part of the tube is displaced in the space by moving into and out of the space during the movement of the carriage unit such that a distance between the part of the tube and the carriage unit is changeable based on a location of the carriage while the carriage reciprocates, wherein when liquid is not ejected onto the medium, the carriage unit waits at a standby position in a first end of a movement path, the curved portion being at a minimum curvature at the standby position, wherein the curved portion is at a maximum curvature at a center portion of the movement path, and wherein a side at a second end of the movement path is a second position, the curved portion having a curvature between the minimum curvature and the maximum curvature at the second position.

* * * * *